US005220127A

United States Patent [19]

Tiomkin et al.

[11] Patent Number: 5,220,127

[45] Date of Patent: Jun. 15, 1993

[54] HATCH ASSEMBLY FOR AN ARMORED VEHICLE

[75] Inventors: Michael Tiomkin; Refael Jhan, both of Beersheva, Israel

[73] Assignee: Israel Aircraft Industries Ltd., Lod, Israel

[21] Appl. No.: 800,504

[22] Filed: Nov. 27, 1991

[30] Foreign Application Priority Data

Dec. 3, 1990 [IL] Israel ..... 96526

[51] Int. Cl.[5] ..... F41H 5/20

[52] U.S. Cl. ..... 89/36.14; 89/40.03

[58] Field of Search ..... 89/36.08, 36.13, 36.14, 89/37.03, 40.03

[56] References Cited

FOREIGN PATENT DOCUMENTS 2926973 1/1981 Fed. Rep. of Germany ..... 89/36.14

2459447 1/1981 France ..... 89/37.03

*Primary Examiner*—Stephen C. Bentley

*Attorney, Agent, or Firm*—Darby & Darby

[57] ABSTRACT

A command hatch assembly for an armored vehicle, the assembly including base apparatus mounted onto an upper portion of the vehicle and having inner and outer portions, the inner portion defining a hatch opening; a hatch cover associated with the hatch opening; apparatus for mounting the hatch cover onto the outer portion of the base apparatus and enabling rotation of the hatch cover between first and second extreme positions, the hatch cover closing the hatch opening when in the first extreme position, and resting on an adjacent portion of the upper portion of the vehicle when in the second extreme position; and apparatus for permitting relative rotation between the inner portion of the base apparatus and the hatch cover when the hatch cover is not in the first extreme position.

26 Claims, 36 Drawing Sheets

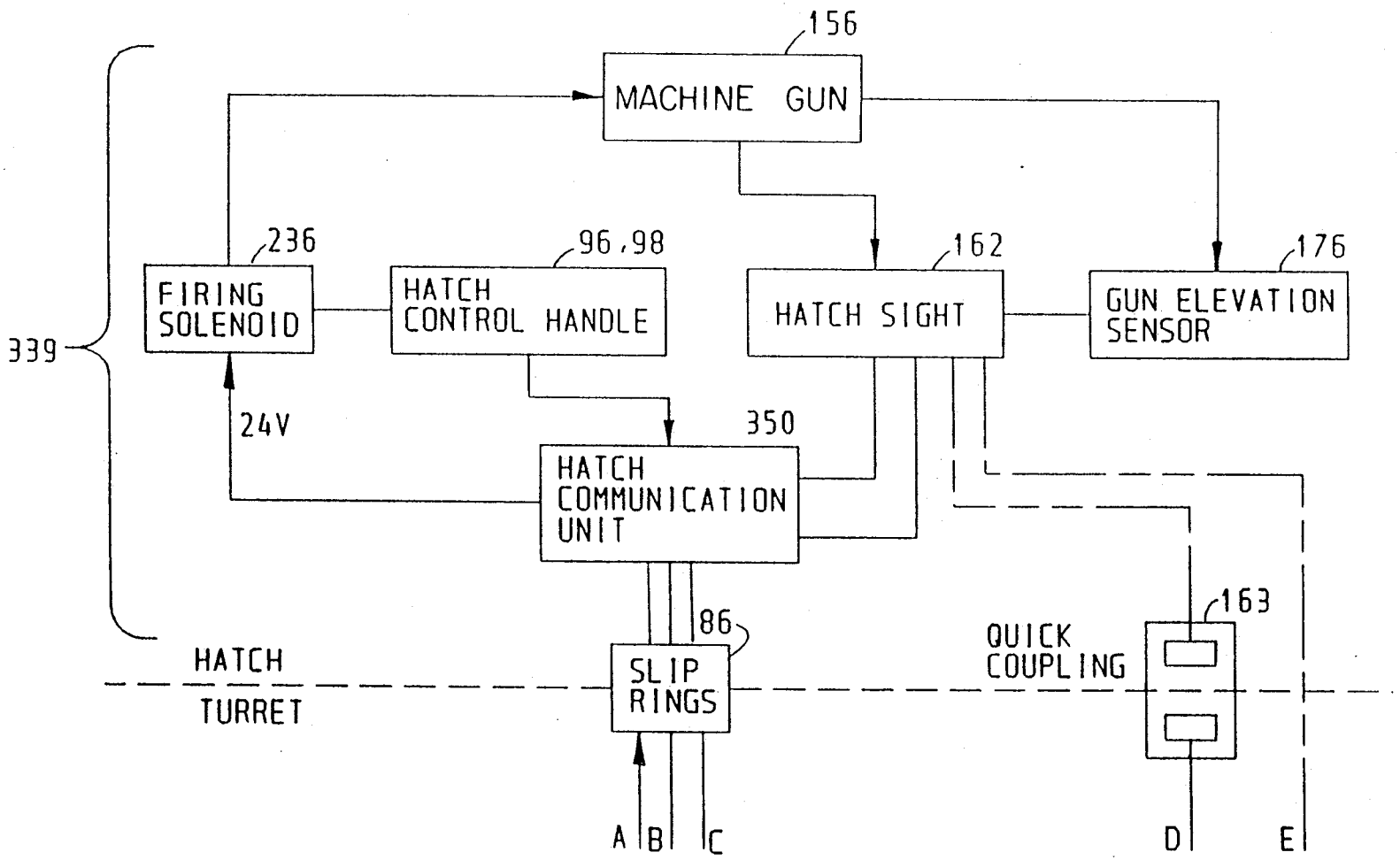
FIG. 15A/1

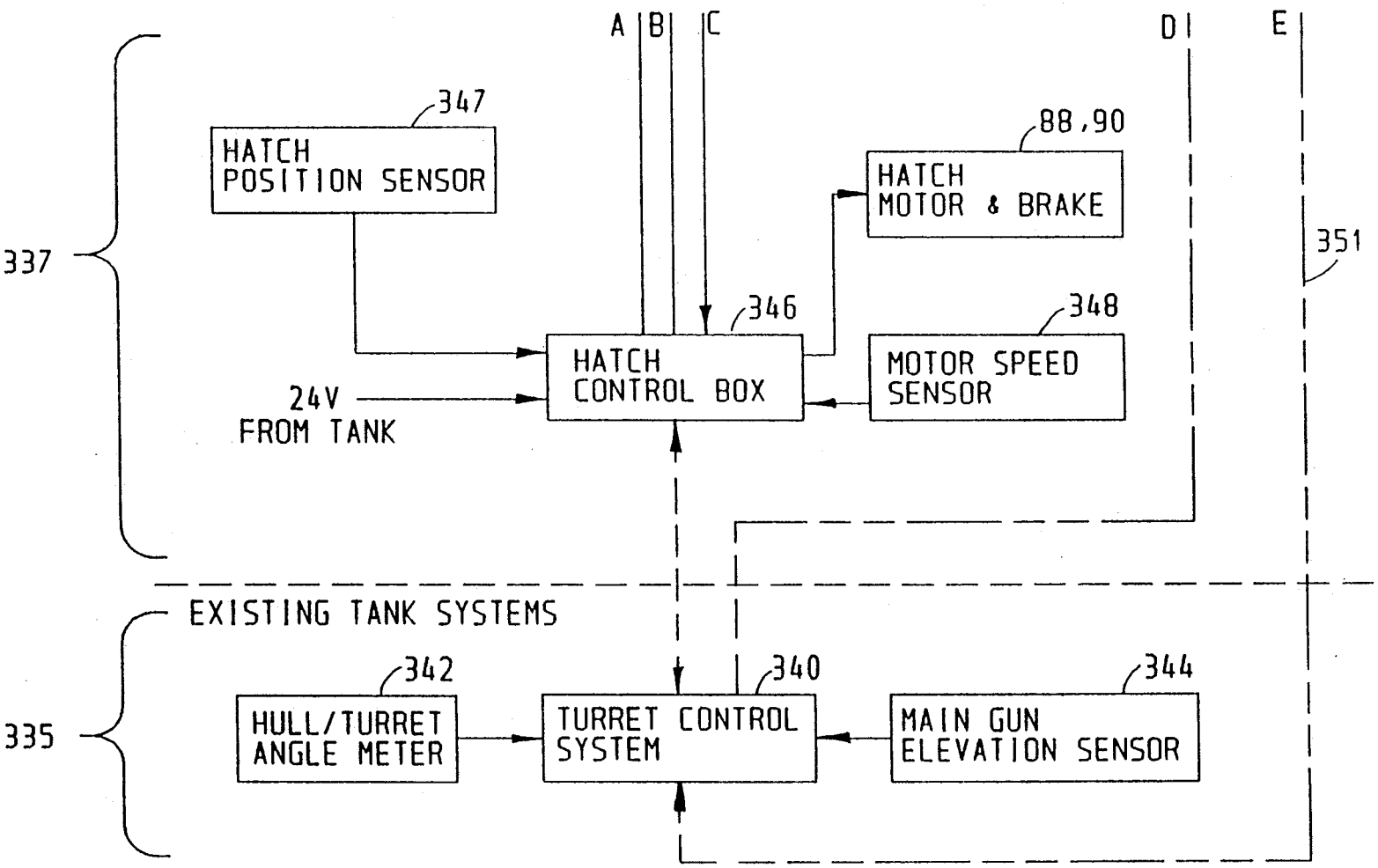
FIG. 15A/2

HATCH ASSEMBLY FOR AN ARMORED VEHICLE

FIELD OF THE INVENTION

The present invention relates to armored vehicles in general and, in particular, to armored vehicles, such as main battle tanks, having one or more hatches located on an upper portion thereof.

BACKGROUND OF THE INVENTION

Armored vehicles, such as the M-1 and M-60 tanks, conventionally include a command hatch assembly, which is intended for use exclusively by the commander of the vehicle. The command hatch assembly, which is located in an upper portion or turret of the vehicle, includes a circular plate defining an opening and is mounted onto the vehicle by means of bearings, so as to be rotatable relative to the remainder of the vehicle. The hatch cover is mounted by hinges onto the circular plate, and is rotatable between a position in which the hatch opening is closed, and an open position, in which the top of the hatch cover rests face down on top of the vehicle.

Although the command hatch assembly is rotatable relative to the remainder of the vehicle, complete rotation of 360° is conventionally not achievable when the hatch cover is in an open position due to surface obstructions such as a machine gun assembly normally mounted adjacent the command hatch assembly.

SUMMARY OF THE INVENTION

The present invention seeks to provide a hatch assembly that may be rotated through 360° even when open, thereby overcoming disadvantages of known art.

There is provided, therefore, in accordance with an embodiment of the invention, a command hatch assembly for an armored vehicle including base apparatus mounted onto an upper portion of the vehicle and having inner and outer portions, the inner portion defining a hatch opening; a hatch cover associated with the hatch opening; apparatus for mounting the hatch cover onto the outer portion of the base apparatus and enabling rotation of the hatch cover between first and second extreme positions, the hatch cover closing the hatch opening when in the first extreme position, and resting on an adjacent portion of the upper portion of the vehicle when in the second extreme position; and apparatus for permitting relative rotation between the inner portion of the base apparatus and the hatch cover when the hatch cover is not in the first extreme position.

According to a further embodiment of the invention, there is provided an armored vehicle having a command hatch assembly which includes base apparatus mounted onto an upper portion of the vehicle and having inner and outer portions, the inner portion defining a hatch opening; a hatch cover associated with the hatch opening; apparatus for mounting the hatch cover onto the outer portion of the base apparatus and enabling rotation of the hatch apparatus between first and second extreme positions, the hatch cover closing the hatch opening when in the first extreme position, and resting on an adjacent portion of the upper portion of the vehicle when in the second extreme position; and apparatus for permitting relative rotation between the inner portion of the base apparatus and the hatch cover when the hatch cover is not in the first extreme position.

Additionally in accordance with an embodiment of the invention, the hatch opening is a first opening and the outer portion of the base apparatus defines a second opening at least partially overlapping the first opening; the inner portion of the base apparatus includes an annular member which is associated with the second opening and which also defines the first opening; and the apparatus for permitting relative rotation includes circular track apparatus disposed between the outer portion and the annular member of the base, and also includes apparatus for selectably locking the annular member to the outer portion, the relative rotation between the inner portion of the base means and the hatch cover being permitted when the apparatus for locking is not operated, and being prevented, when the apparatus for locking is operated.

Further in accordance with an embodiment of the invention, the circular track apparatus includes an inner track member rotationally associated with the annular portion coaxially mounted within an outer track member associated with the outer portion of the base apparatus.

BRIEF DESCRIPTION OF THE DRAWINGS

The present invention will be more fully understood and appreciated from the following detailed description, taken in conjunction with the drawings, in which:

FIG. 15A is a block diagram illustration of control and monitoring systems of the apparatus of the present invention incorporated into a battle tank;

DETAILED DESCRIPTION OF THE INVENTION

Figure 1A:
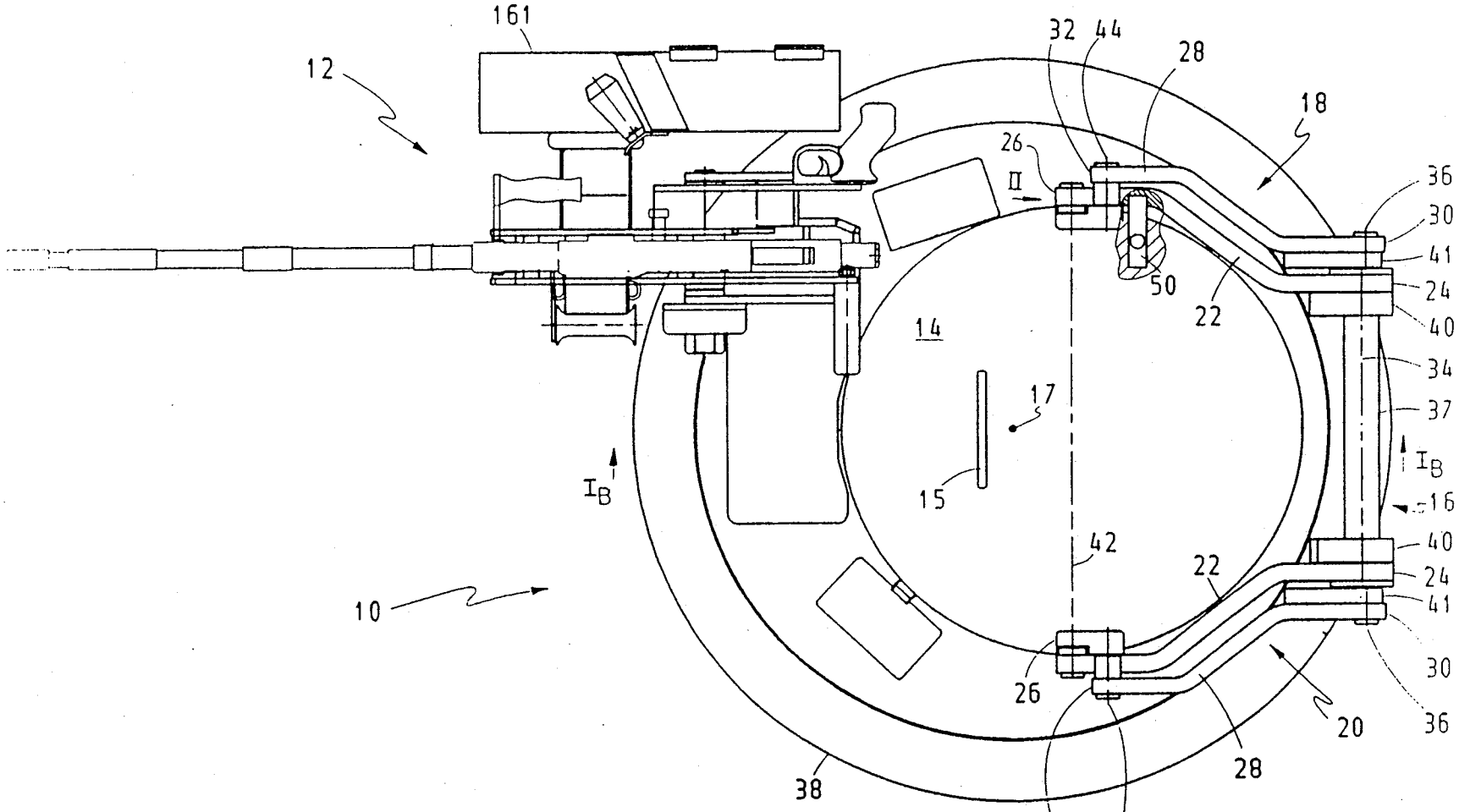
FIGS. 1A and 1B are respective schematic plan and sectional views of an armored vehicle hatch assembly and machine gun system, constructed and operative according to the present invention.
Figure 1B:
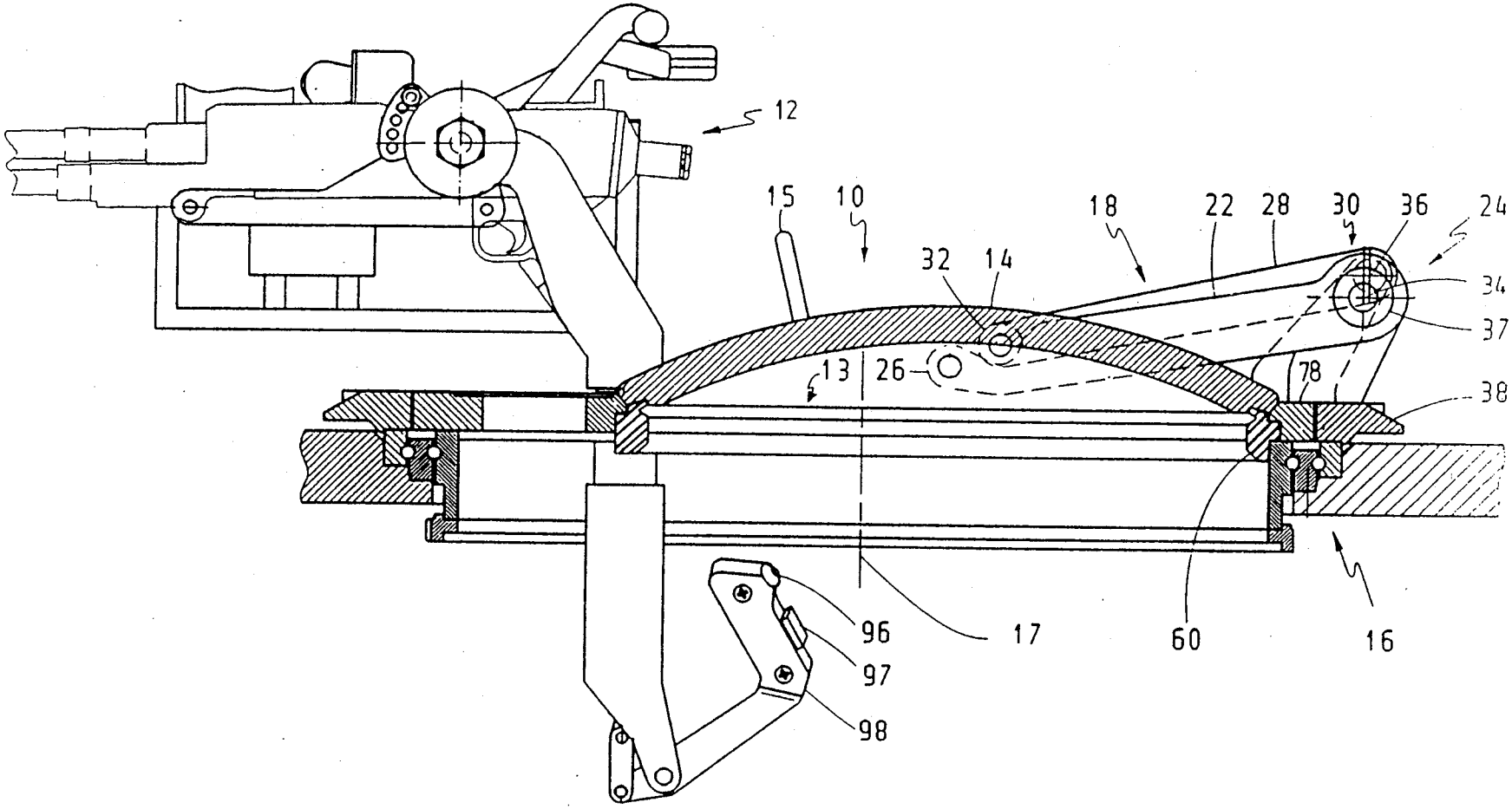

Reference is now made to FIGS. 1A and 1B, in which there are shown respective schematic plan and sectional views of an armored vehicle hatch assembly, referenced generally 10, and a machine gun system, referenced generally 12, constructed and operative according to the present invention. The vehicle of which assembly 10 and system 12 form a part may be a main battle tank, for example, the M-1 or M-60 tank, although this is not intended to exclude the incorporation of either the hatch assembly or the machine gun system of the present invention into any other type of vehicle, typically an armored vehicle, such as an armored personnel carrier. Although the vehicle is not shown in the present drawings, it is illustrated schematically in, inter alia, FIG. 7A, wherein the respective positions of the command hatch assembly and the machine gun system relative to the rest of the vehicle are clearly shown.

In addition, for illustrative purposes, the hatch assembly 10 is described below, particularly in conjunction with FIGS. 7A–16, in the context of a command hatch assembly, although hatch assembly 10 of the invention may be used to replace any existing hatch assembly provided in an armored vehicle.

As will be appreciated from the ensuing description, either of hatch assembly 10 and machine gun system 12 may be provided separately. According to the present embodiment, however, they are provided together.

Assembly 10 defines a typically circular opening 13 having a hatch cover 14, mounted onto rotational mounting apparatus, referenced generally 16, (described hereinbelow in conjunction with FIG. 5) by a four bar system which includes two pairs of similar, cranked arms, respectively referenced 18 and 20. Each pair of arms has an inner arm 22, having first and second ends, respectively referenced 24 and 26; and an outer arm 28, having first and second ends respectively referenced 30 and 32. Hatch cover 14 also has a handle, referenced 15.

First ends 24 and 30 of the respective inner and outer arms are mounted for pivoting about respective, parallel axes 34 and 36. Axis 34 is defined, as shown, by an elongate member 37, which is itself supported by a portion 38 of the rotational mounting apparatus 16, via supports 40 and 41 mounted thereon.

Figure 2A:
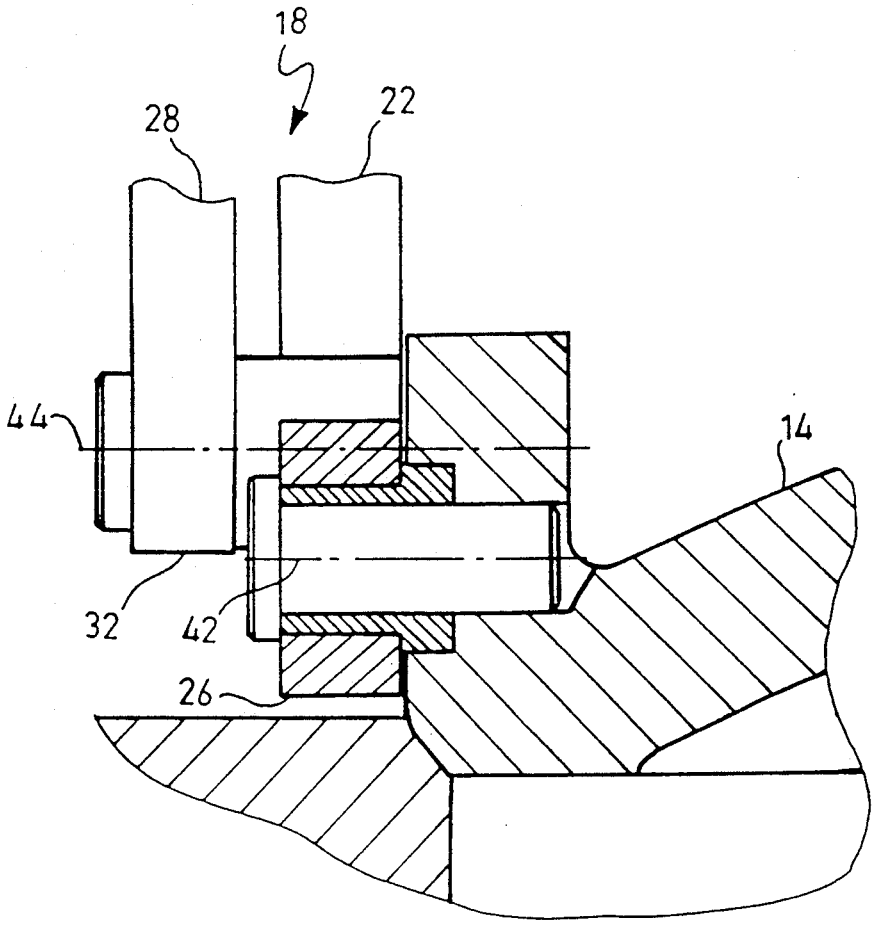
FIGS. 2A and 2B are respective detailed views of a mounting portion of the hatch cover illustrated in FIG. 1A and taken in the direction of arrow II therein, and of hatch cover locking apparatus, also illustrated in FIG. 1A.

Referring now also to FIG. 2A, second ends 26 and 32 of the respective inner and outer arms are pivotably attached to hatch cover 14 along spaced apart, parallel axes, respectively referenced 42 and 44.

Figure 2B:
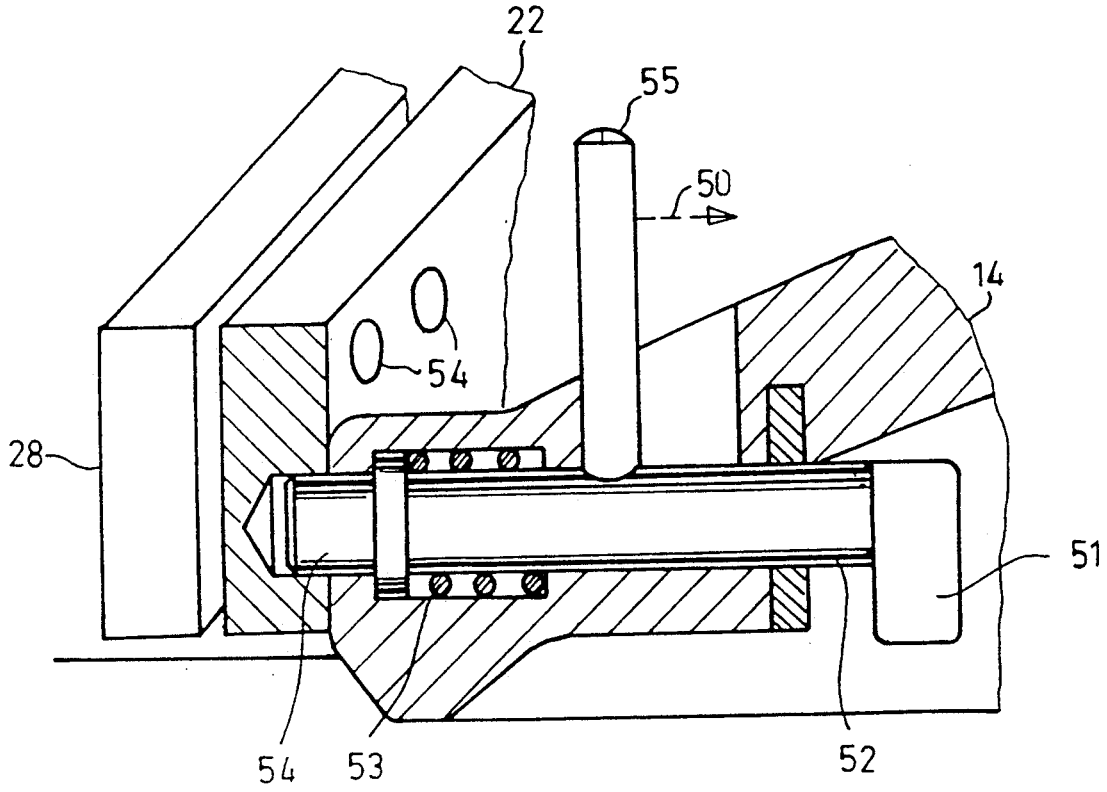
Figure 3:
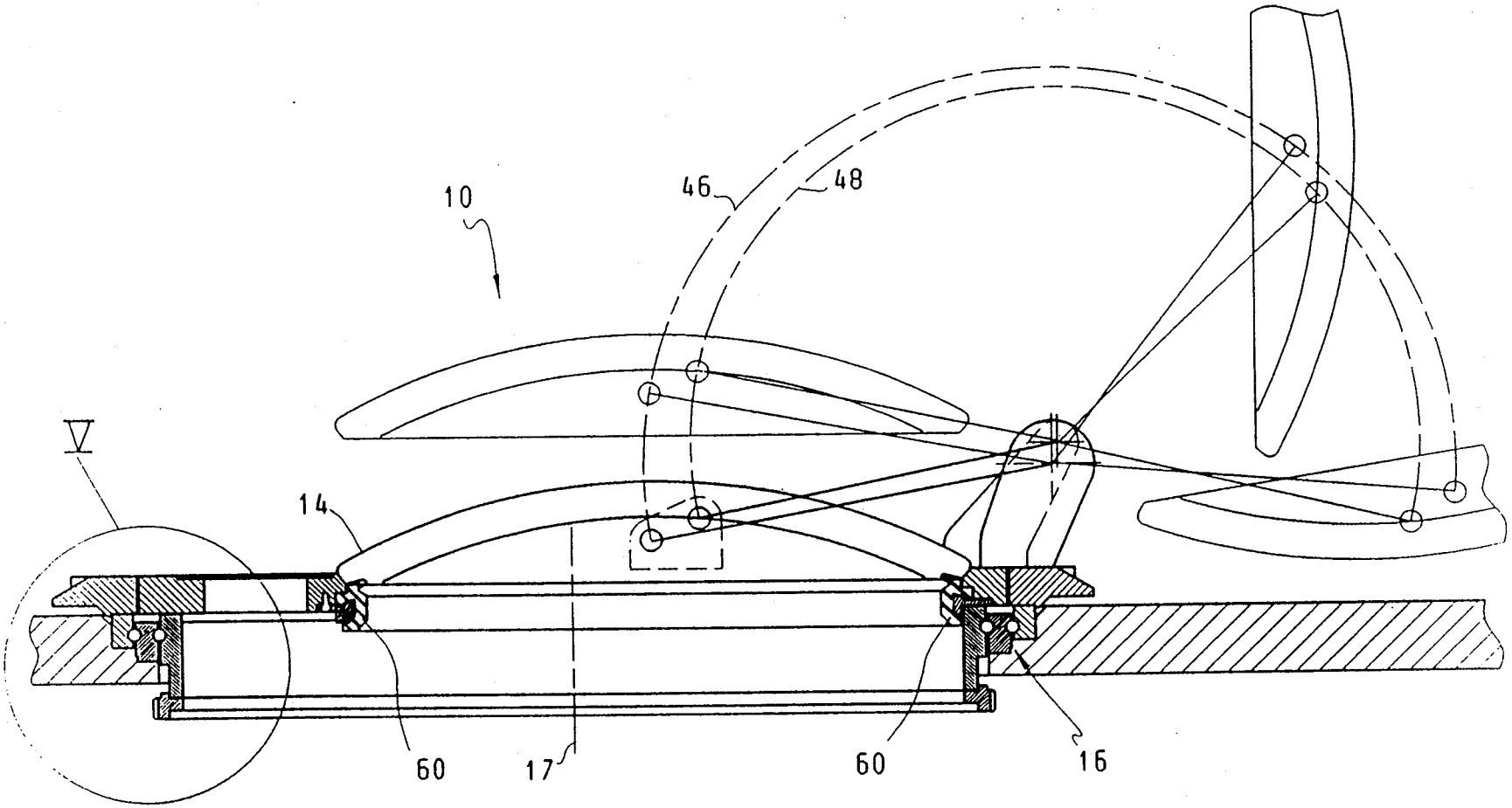
FIG. 3 shows a plurality of predetermined positions at which the hatch cover of FIGS. 1A and 1B may be arranged relative to the hatch opening.

With reference also to FIG. 3, the geometry of the arrangement by which hatch cover 14 is mounted onto rotational mounting apparatus 16, dictates a predetermined angular disposition of the hatch cover for any of the non-closed positions of the cover in the arcs illustrated by dashed lines 46 and 48. There is also provided apparatus, referenced generally 50 (FIGS. 1A and 2B), for locking the hatch cover 14 in any selected position.

With particular reference to FIG. 2B, locking apparatus 50, which preferably is operable from inside the hatch, typically includes a single spring loaded locking pin 52 mounted onto hatch cover 14 and arranged for engagement with a selected one of a plurality of apertures 54 formed in one of the inner arms 22 of the four bar system. It will be appreciated that the locking of the four-bar system by a single pin is very quick and convenient, and that it is operative to lock the system absolutely. With conventional hatch mounting systems, two locking pins are provided to achieve positioning of the hatch cover such as provided in the present invention by the four-bar system.

Apparatus 50, as illustrated, is normally locked, and axial retraction of locking pin 52 via an interior handle portion 51 against the urging of spring 53 causes disengagement of pin 52 from an engaged aperture 54 and, therefore, being operative to release the hitherto locked inner arm 22. Although only three apertures are illustrated, any preferred number of such apertures may be provided corresponding to the different positions at which it may be sought to lock the hatch cover.

While interior handle portion 51 permits the locking of the hatch cover 14 in a selected position from inside a vehicle, an exterior handle portion 55, attached to the locking pin 52, is provided for opening the hatch cover from outside the vehicle.

Figure 4:
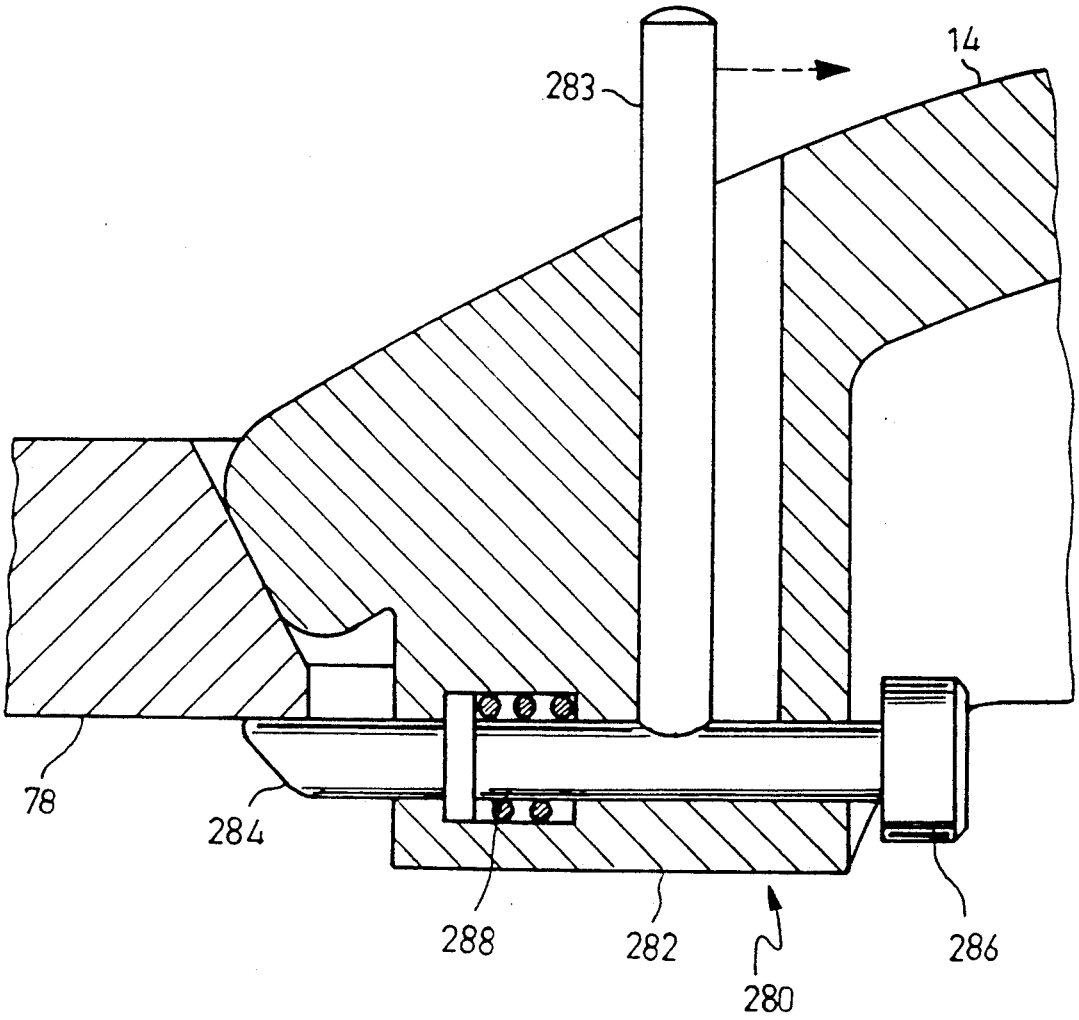
FIG. 4 is a schematic, cut-away view of a hatch cover locking mechanism, constructed according to an embodiment of the invention.
Figure 4A:
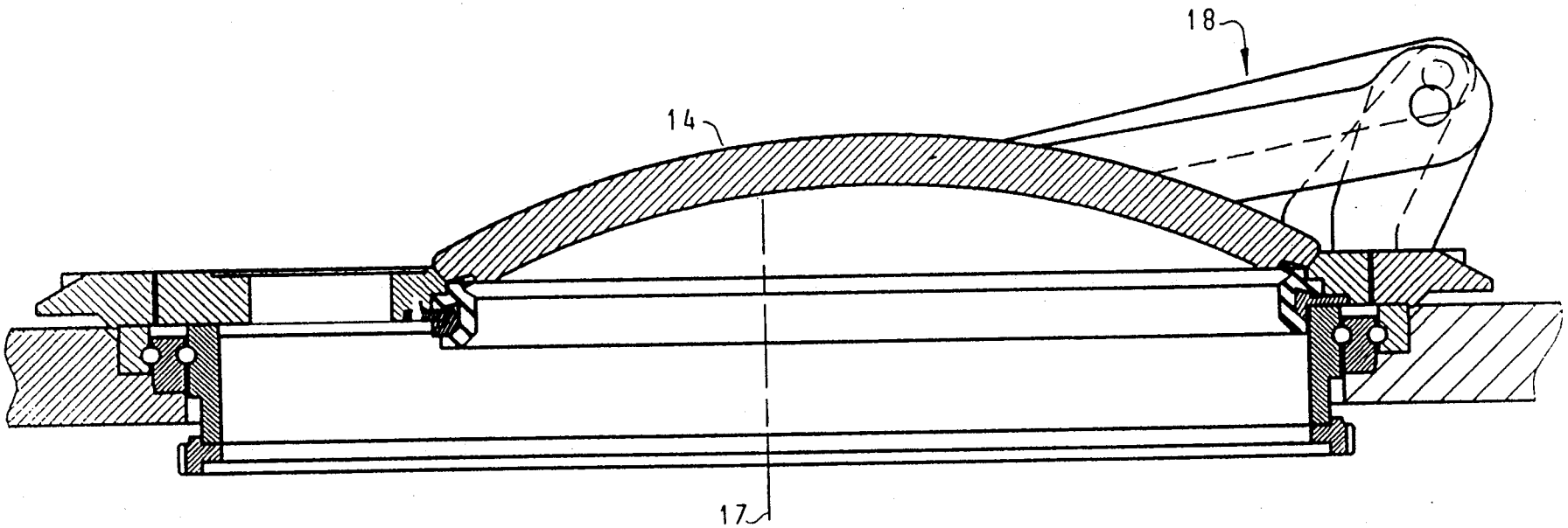
FIGS. 4A–4D are schematic, side-sectional views of the hatch assembly of the invention, each showing a different one of the hatch cover positions shown in FIG. 3.
Figure 4B:
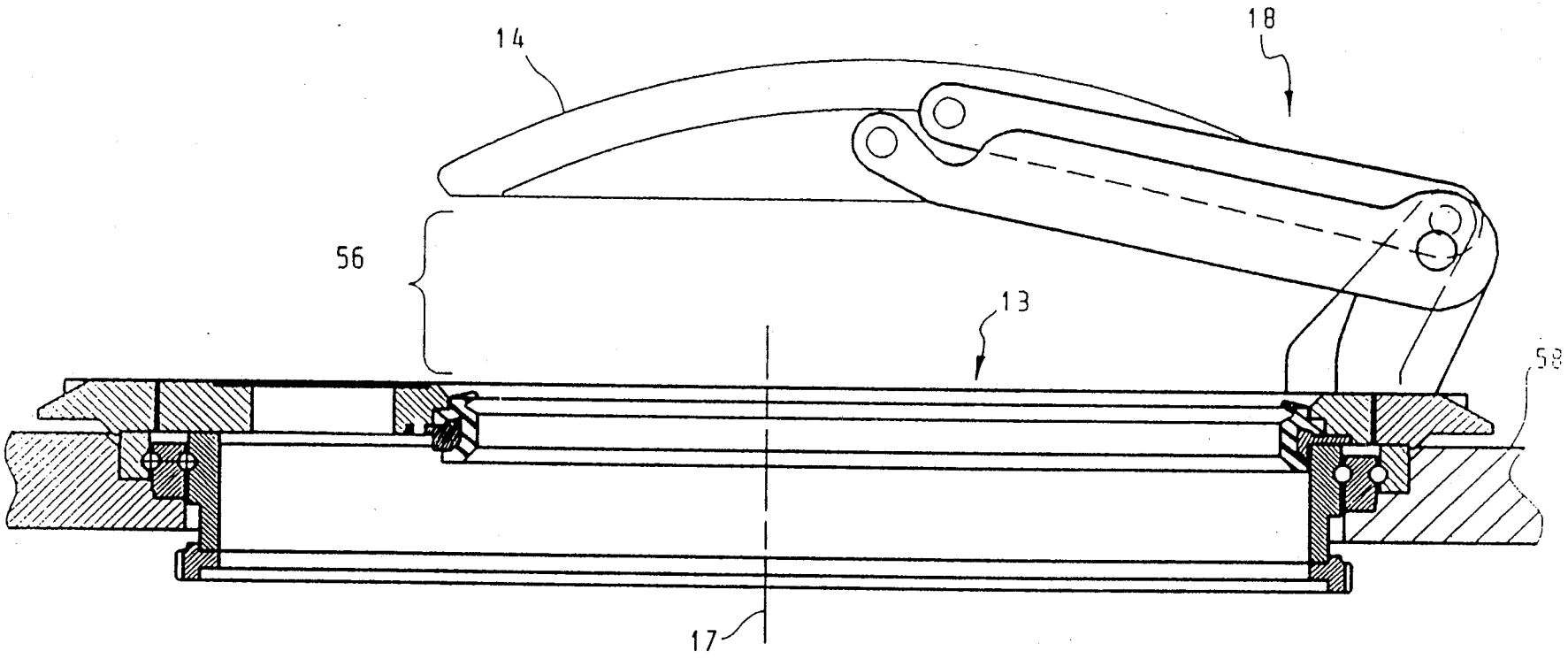
Figure 4C:
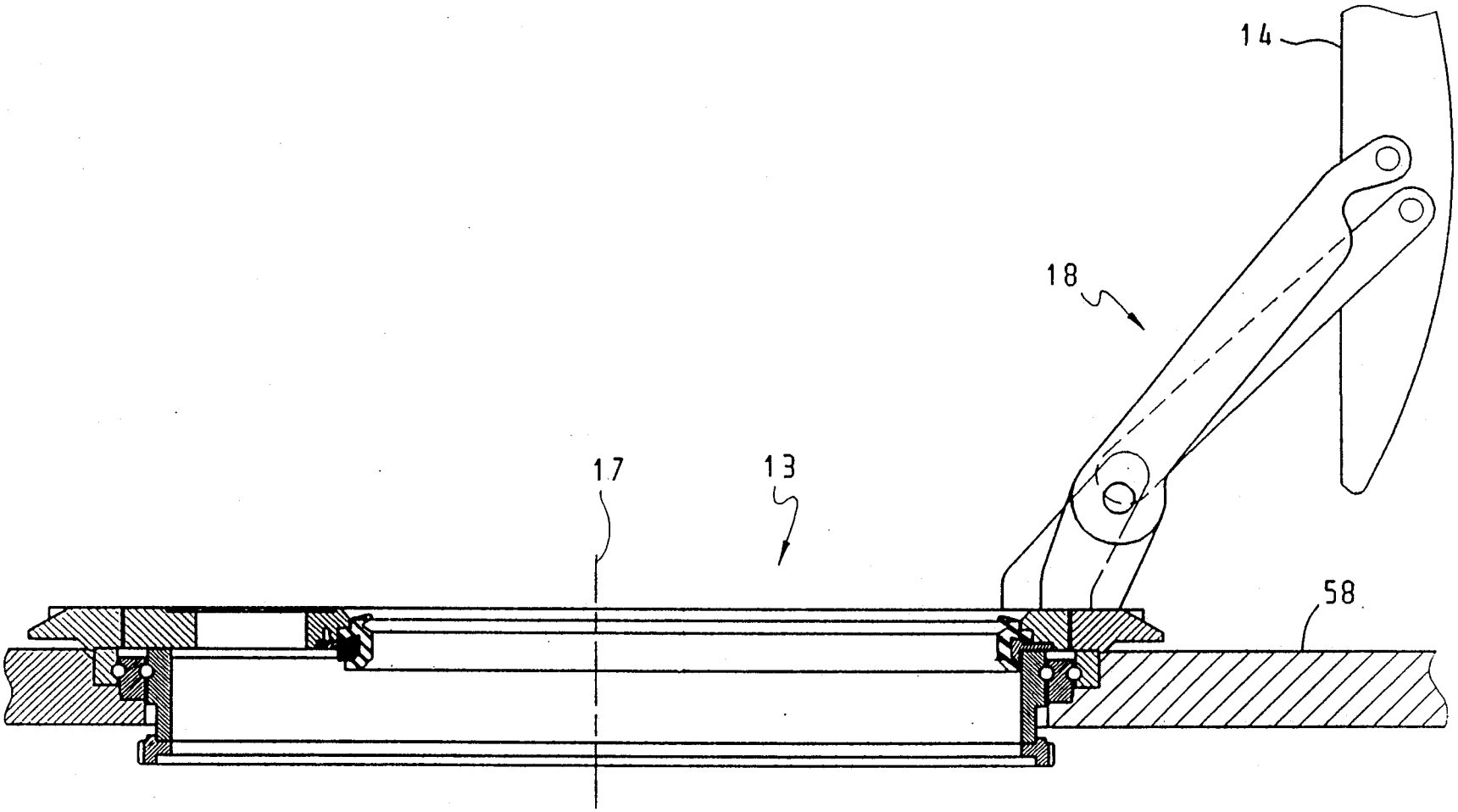
Figure 4D:
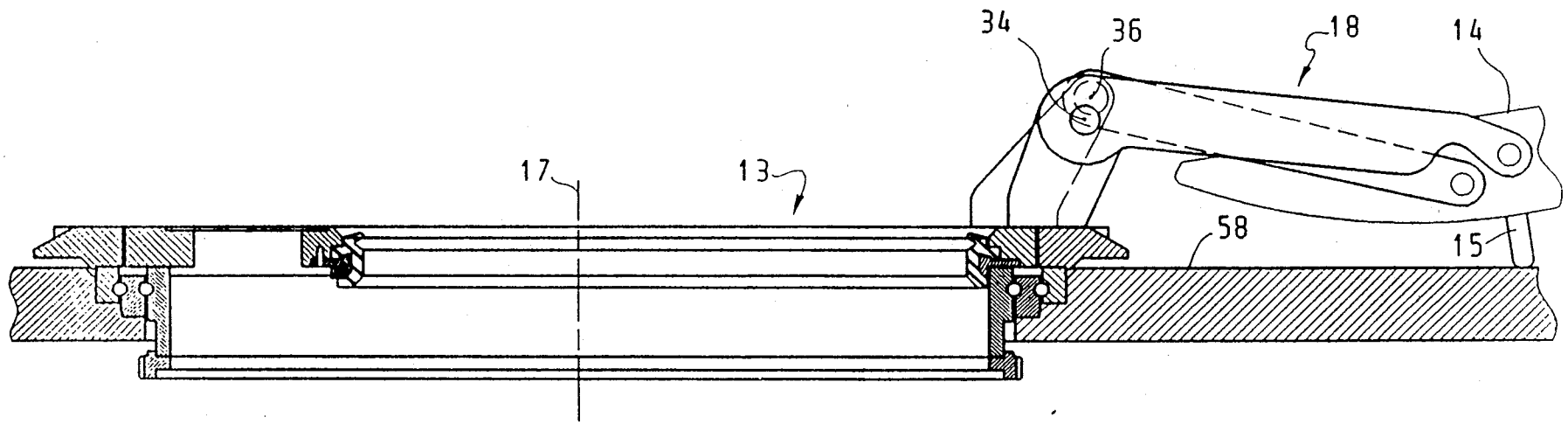

Illustrated together in FIG. 3, and individually in FIGS. 4A–4D, are four different positions at which it may be sought to lock the hatch cover. The positions shown in FIGS. 4A–4D are as follows: closed (FIG. 4A); generally parallel to the closed position, but defining a slit opening 56 with the top surface 58 of the vehicle (FIG. 4B); perpendicular to the top surface 58 of the vehicle (FIG. 4C); and lying on the top of the vehicle (FIG. 4D). In the position illustrated in FIG. 4D, the hatch cover is locked to the top surface 58 as by any suitable catch mechanism (not shown).

Figure 16:
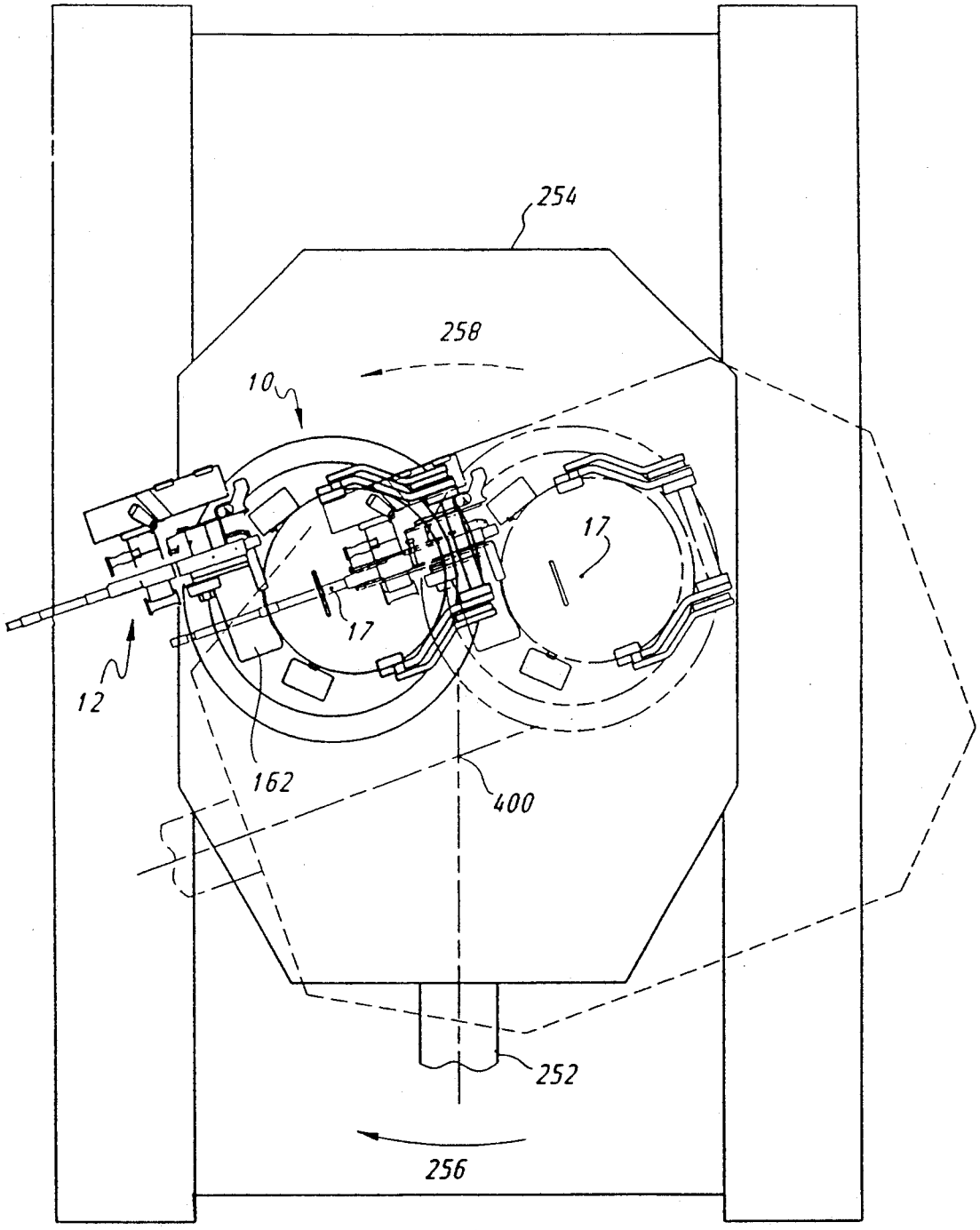
FIG. 16 is a plan view of an armored vehicle having a turret and including the hatch assembly of the present invention, and illustrating, in superimposed fashion, the turret and hatch assembly positions at initiation of a 'counter rotation' mode and termination of the counter rotation mode respectively.

With particular reference to FIG. 4D, opening of the hatch cover 14 to the open position illustrated, in which the cover is lying on top of the vehicle, is possible only when the hatch assembly is in a predetermined "index" position. Typically the index position is defined by the positioning of the hatch assembly such that axes 34 and 36 are perpendicular to the longitudinal axis of the main gun 252 (FIG. 16).

With reference now to FIG. 4, hatch cover 14 may be locked in its closed position (also illustrated in FIG. 4A), by means of a simple catch mechanism, referenced generally 280. Catch mechanism 280 is mounted typically on the underside of cover 14 and includes a housing 282 through which extends a spring-retained catch 284. Catch 284 is normally in the illustrated, extended position so as to engage the underside of a base member 78 (also FIGS. 1B and 5) and prevent opening of cover 14. Catch 284 may be retracted by pulling it, via an interior handle portion 286, against the urging of spring 288, so as to permit the opening of cover 14 from inside a vehicle. Similar operation of the catch may be achieved from outside the vehicle via an exterior handle portion 283 attached to catch 284.

Also shown, inter alia, in FIGS. 1B and 3, are rubber gaskets 60, for sealing the interior of the vehicle from the atmosphere when the hatch cover 14 is closed, such as is required, for example, under conditions of nuclear, biological and chemical warfare.

Figure 5:
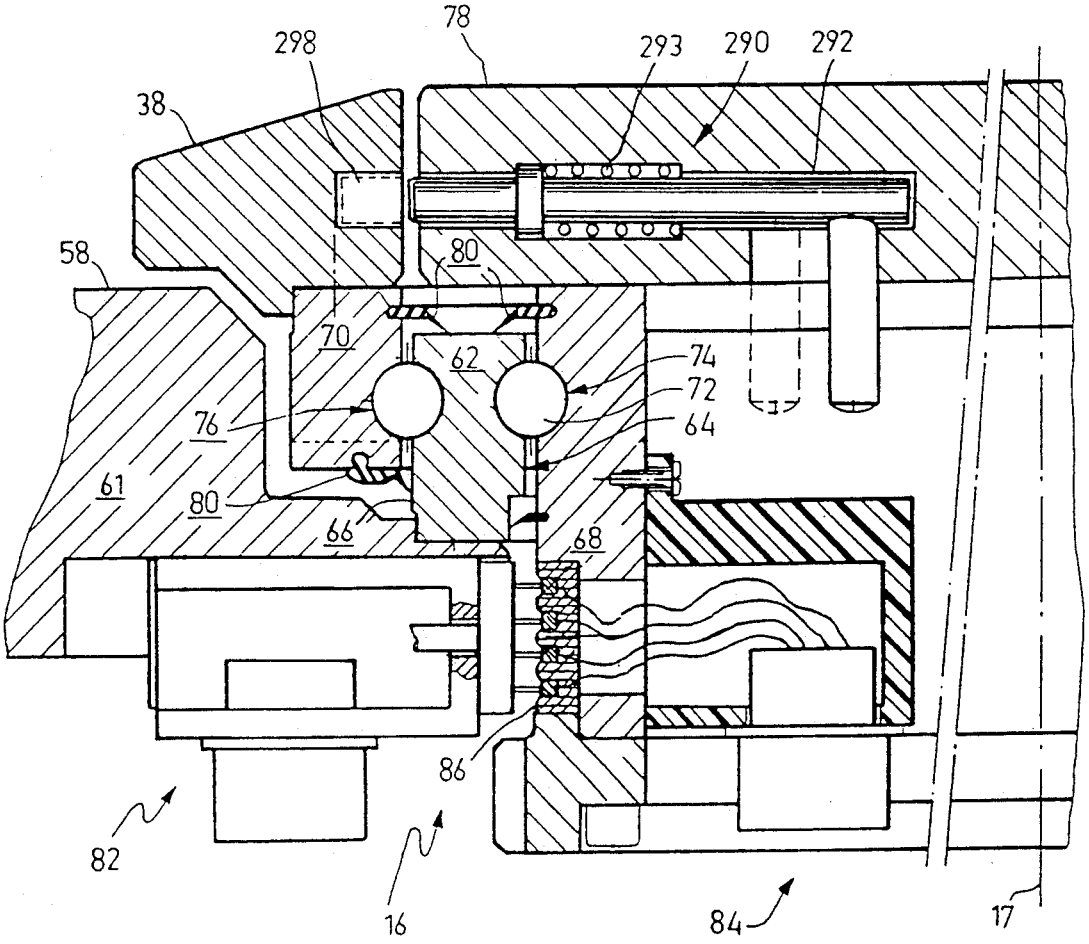
FIG. 5 is a detailed sectional view of a portion of rotational mounting apparatus constituting part of the hatch assembly, as indicated by arrow V in FIG. 3.

Reference is now made to FIG. 5, which is a detailed sectional view of a portion of rotational mounting apparatus 16, constructed in accordance with the present invention. Apparatus 16 is constructed so as to permit either rotation about axis 17 of the entire hatch assembly 10, including cover 14 (when closed), relative to the body of the vehicle or, operative disconnection of the hatch cover 14 (when open) relative to the remainder of the assembly, thereby enabling rotation of the assembly relative to its hatch cover as well as to the body of the vehicle.

For convenience, in the ensuing description, the invention is described below in association with a vehicle having a 'hull' and a 'turret' wherein 'hull' is used to refer to a lower portion of the vehicle and 'turret' is used to refer to an upper vehicle portion rotatable relative to the hull. This is not intended, however, to limit the invention specifically to a vehicle, such as a tank, having a turret and hull. Assembly 10 and system 12 of the invention may be equally useful in conjunction with, for example, an armored personnel carrier.

In the present example, apparatus 16 includes a circular track member 62 fixed to turret 61 of the vehicle and having inner and outer faces, respectively referenced 64 and 66. Respective inner and outer rings, 68 and 70, are bearing-mounted for mutually independent coaxial 360° rotation relative to and along track member 62. Registration of the rings 68 and 70 with each other and with track member 62 is provided by typically spherical bearings 72 arranged within channels 74 and 76, which are defined by respective inner and outer rings 68 and 70 together with respective inner and outer faces 64 and 66 of track member 62. Alternatively, other types of bearings, such as roller bearings may be employed in place of the spherical bearings 72. The double-ring construction constituted by track member 62 and rings 68 and 70 may be, for example, as manufactured by ROLLIX GROUPE DEFONTAINE, of 3, Rue Louis Renault, B.P. 47, 44802, Saint Herblain Cedex, FRANCE.

Alternatively, the above-described double-ring construction may be replaced by an alternative equivalent mounting system.

The hatch opening 13 (FIG. 1B) is defined by a generally planar base member 78 (FIGS. 1B and 5). The base member 78 is rigidly mounted onto inner ring 68 for rotation relative to track member 62, and is thus rotatable through 360° independently of portion 38, which constitutes an upper ring member of the assembly, and which is mounted onto outer ring 70 for rotation relative to track member 62.

Illustrated schematically in FIG. 5 is spring-loaded apparatus referenced generally 290, for connecting together base member 78 with portion 38. When the hatch cover 14 is open and lying on top of the vehicle, as illustrated in FIG. 4D, base member 78 may be unlocked from portion 38 by disengagement of a spring-loaded pin 292 from a bore 298 formed in portion 38. According to the illustrated embodiment, this is achieved by rearward axial movement of pin 292, via a handle 294, so as to compress spring 293 and so as to be moved into a disengaged position, shown in solid lines. The pin 292 may be locked in the illustrated disengaged position by any suitable means (not shown).

Re-connection of base member 78 and portion 38 may be achieved while the hatch cover is lying on top of the vehicle, as illustrated in FIG. 4D; by unlocking pin 292 such that it is urged by spring 293 toward portion 38; and by rotation of base member 78 until the index position is reached, whereat pin 292 becomes realigned with bore 298 so as to become engaged therewith.

It will thus be apparent that when pin 292 is disengaged from bore 298, 360° axial rotation of base member 78 may be achieved, for example, when hatch cover 14, which is mounted onto hatch portion 38, is in the fully open position shown in FIG. 4D, lying on top surface 58 of the turret, independently of the hatch cover 14 which, as described above, is mounted solely onto portion 38. When, however, hatch cover 14 is in a closed position (FIG. 4A) and base member 78 is locked together with hatch portion 38, the entire hatch assembly—including the hatch cover—is rotatable relative to turret 61. In an intermediate position, in which hatch cover 14 is still connected to the remainder of the hatch assembly 10, such as illustrated in FIGS. 4B and 4C, hatch assembly 10 may be rotated about axis 17 in the absence of any obstruction to hatch cover 14, such as may be caused by appurtenances mounted onto the turret, in the sought path of travel thereof.

Rubber sealing gaskets 80 are also provided, as shown, to prevent the entry of dirt and of dangerous substances such as are present in the atmosphere under conditions of nuclear, biological and chemical warfare.

As will be appreciated from the ensuing description, and, in particular from the description of FIG. 15, there are various systems in assembly 10 and system 12 that are electrically powered from a main power source of the vehicle, and that exchange signal information with other systems in the vehicle. Accordingly, there is provided a conventional type of electrical signal conduction system including turret-located electrical connector apparatus illustrated schematically at 82; hatch-located electrical connector apparatus illustrated schematically at 84; and slip ring apparatus 86 for conducting electrical signals between apparatus 82 and apparatus 84. It will thus be appreciated that the slip ring apparatus is operative to carry all the electrical signals between systems in the hatch assembly 10 and systems located in a lower portion of the vehicle.

Figure 6:
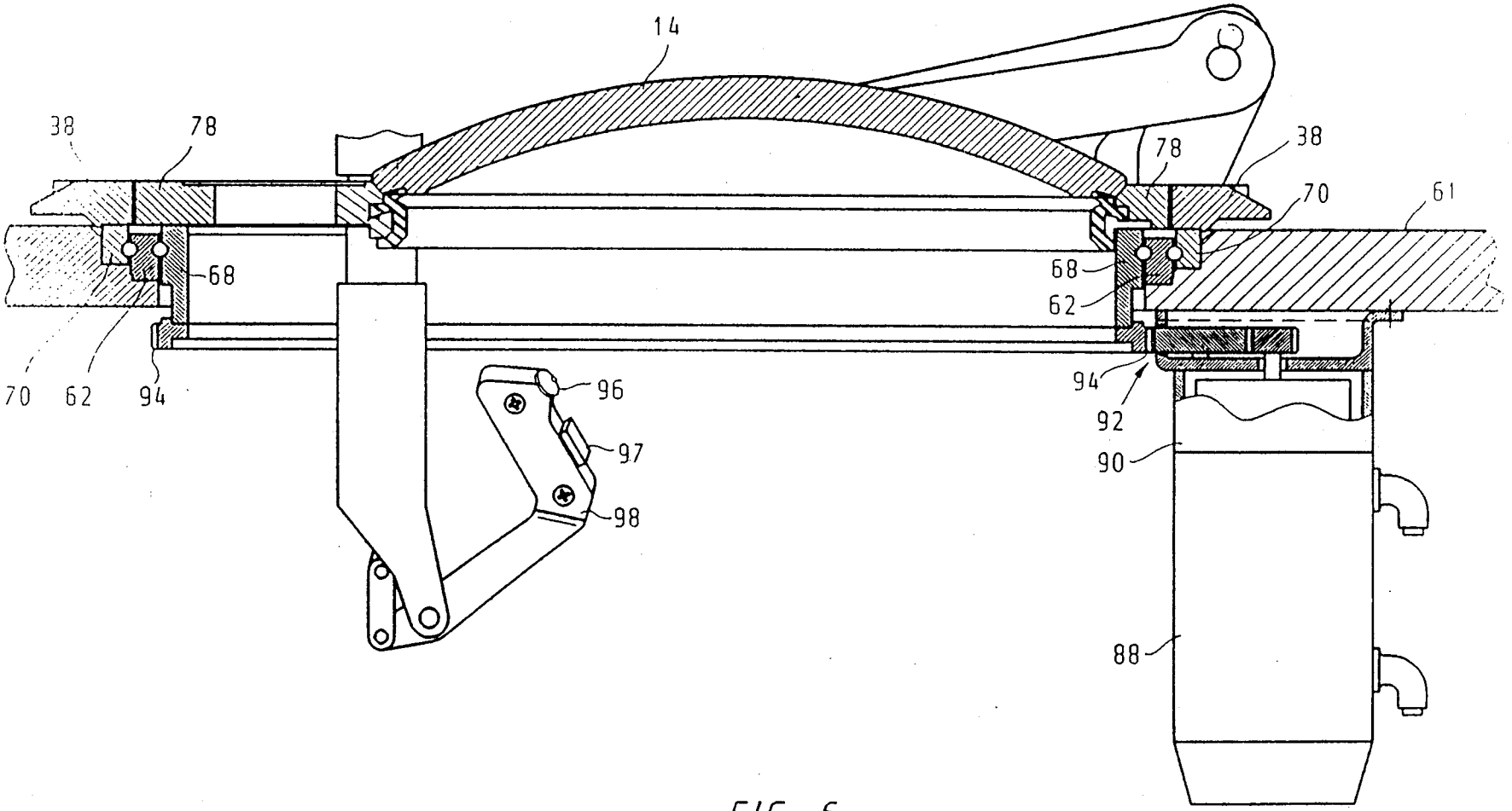
FIG. 6 is a schematic side-sectional view of the hatch assembly of the invention, and showing apparatus for providing rotation thereof relative to the body of the vehicle.

Reference is now made also to FIG. 6, which is a side-sectional view of hatch assembly 10, and which also shows drive apparatus for rotating a central portion of the hatch assembly relative to the turret 61. The apparatus includes a motor 88, which may be any suitable, mechanical, electrical, or hydraulic motor, a gear unit 90 and an arrangement 92 of gear wheels driven by the motor and gears and operative to engage and rotate an annular toothed member 94 fixed to inner ring 68. Operation of the drive apparatus in the present embodiment is via a directional toggle switch 96 mounted for convenience onto a handle 98 of machine gun system 12. Movement of the directional switch 96 in a selected direction is operative to activate the drive apparatus to rotate the inner ring 68 accordingly. A safety catch 97 is also shown in the form of a grip catch, and this must be continuously depressed while rotating the hatch assembly.

It will be appreciated that directional switch 96 and safety catch 97 are provided in alternative positions when the machine gun system 12 is not incorporated in the hatch assembly 10 of the invention.

Figure 7A:
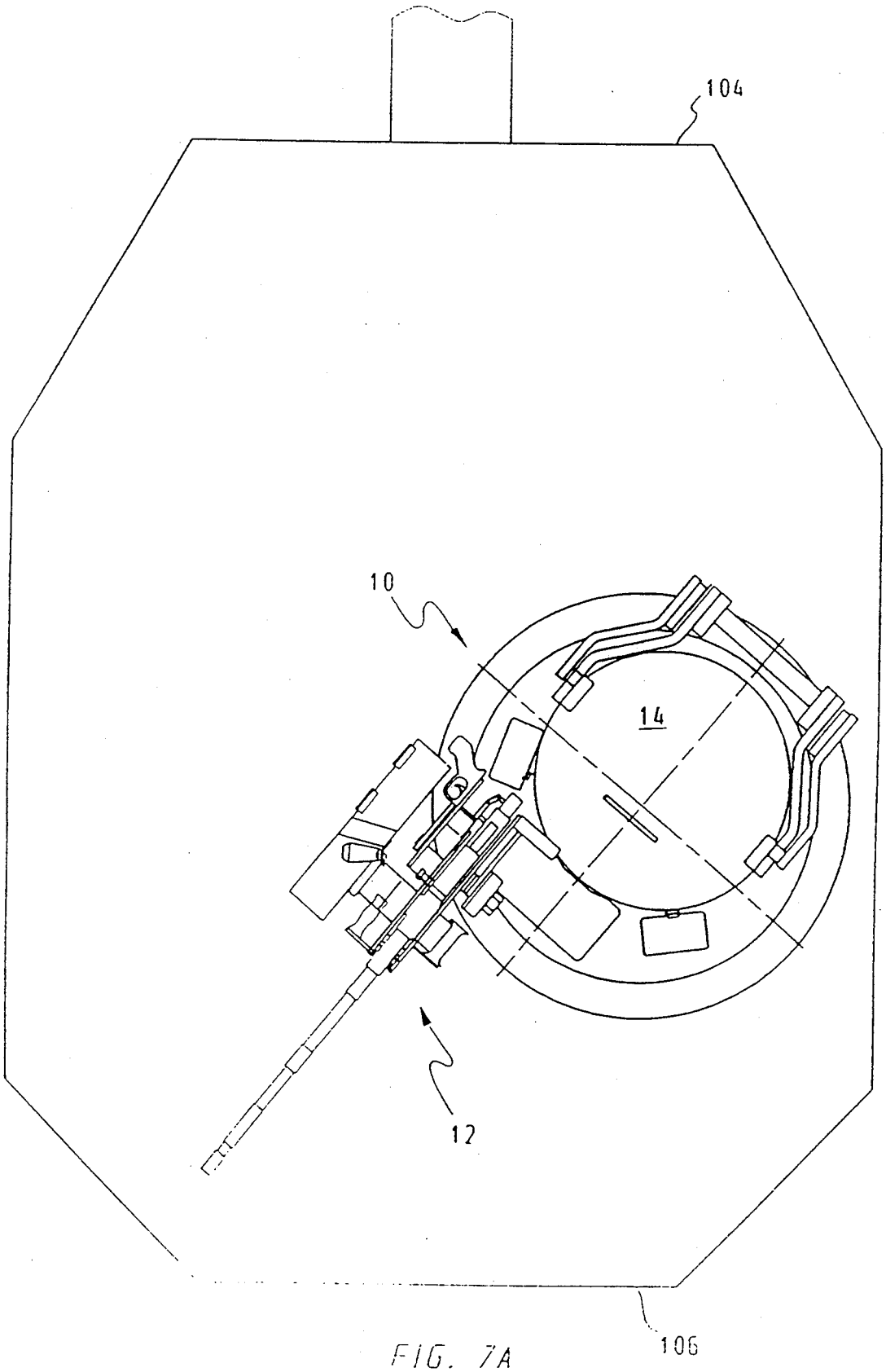
FIGS. 7A and 7B are schematic plan views of a battle vehicle whose command hatch assembly is constructed according to the embodiment of FIGS. 1A–6, showing the hatch cover in different rotated positions relative to the body of the vehicle.
Figure 7B:
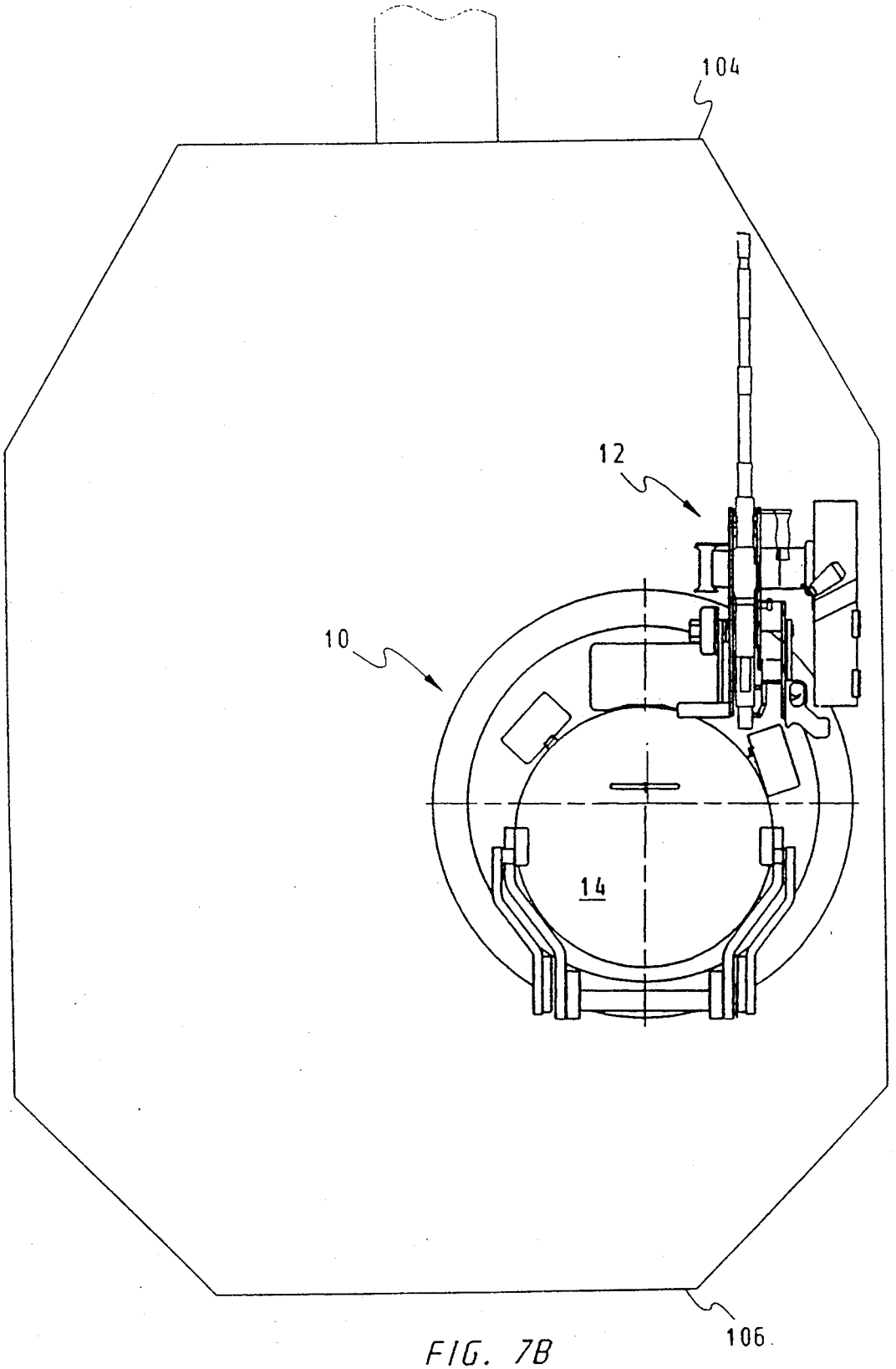

Referring now briefly to FIGS. 7A and 7B, there is shown a vehicle 104, such as a main battle tank, which includes a hatch assembly 10 constructed according to the embodiment of FIGS. 1A–6, and wherein the hatch cover 14 is in a closed position. As facilitated by the above-described double ring construction of the rotational mounting system 16, the hatch assembly, including the hatch cover 14, is capable of being rotated through 360°, a different exemplary position being shown in each of FIGS. 7A and 7B.

Figure 8:
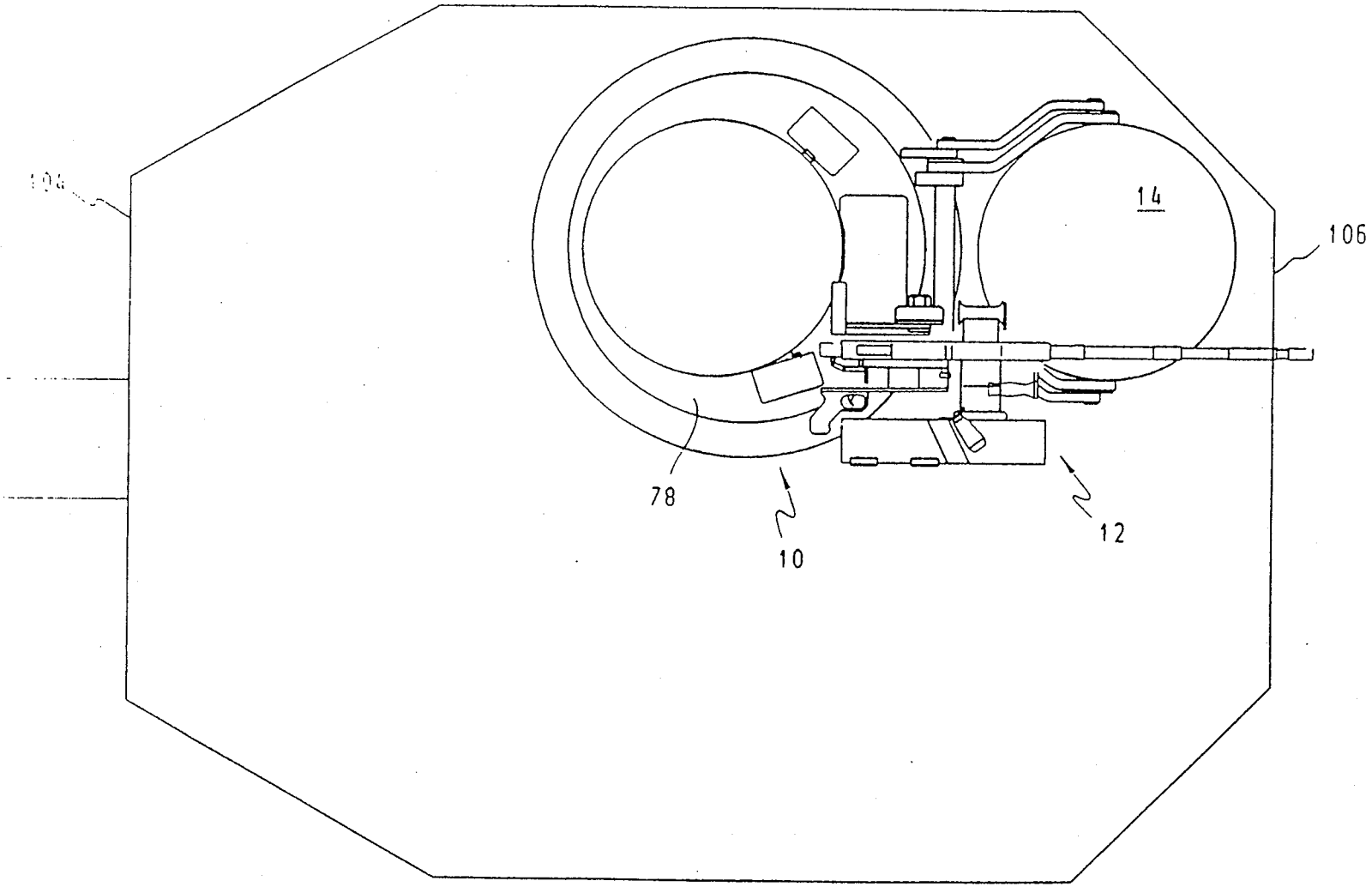
FIG. 8 is a schematic plan view similar to that of FIG. 7B, but wherein the hatch cover has been operatively disconnected from the rotational mounting apparatus of the hatch assembly and the hatch assembly is shown in a rotated position relative to its hatch cover.

In FIG. 8, however, the hatch cover is shown in an open position (as shown in FIG. 4D), and the top inner ring 68 and thus base member 78 and equipment carried thereby, have been rotated through 180° relative to the forward-looking position shown in FIG. 7B and relative to hatch cover 14, so as to be facing towards a rear end 106 of the vehicle 104.

Figure 9A:
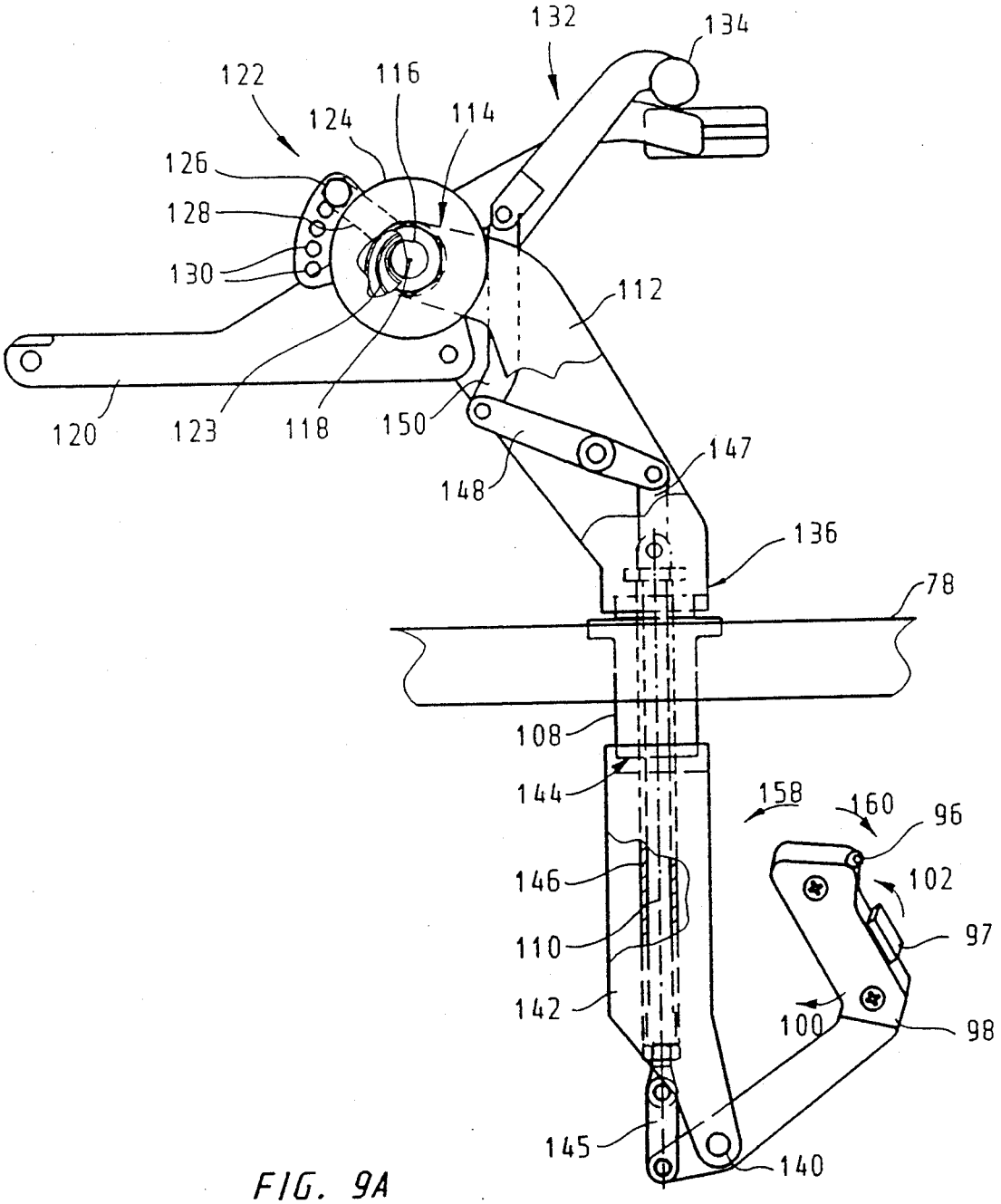
FIGS. 9A and 9B are respective side and partial sectional views of the machine gun mount forming part of the machine gun system shown in FIGS. 1A and 1B.
Figure 9B:
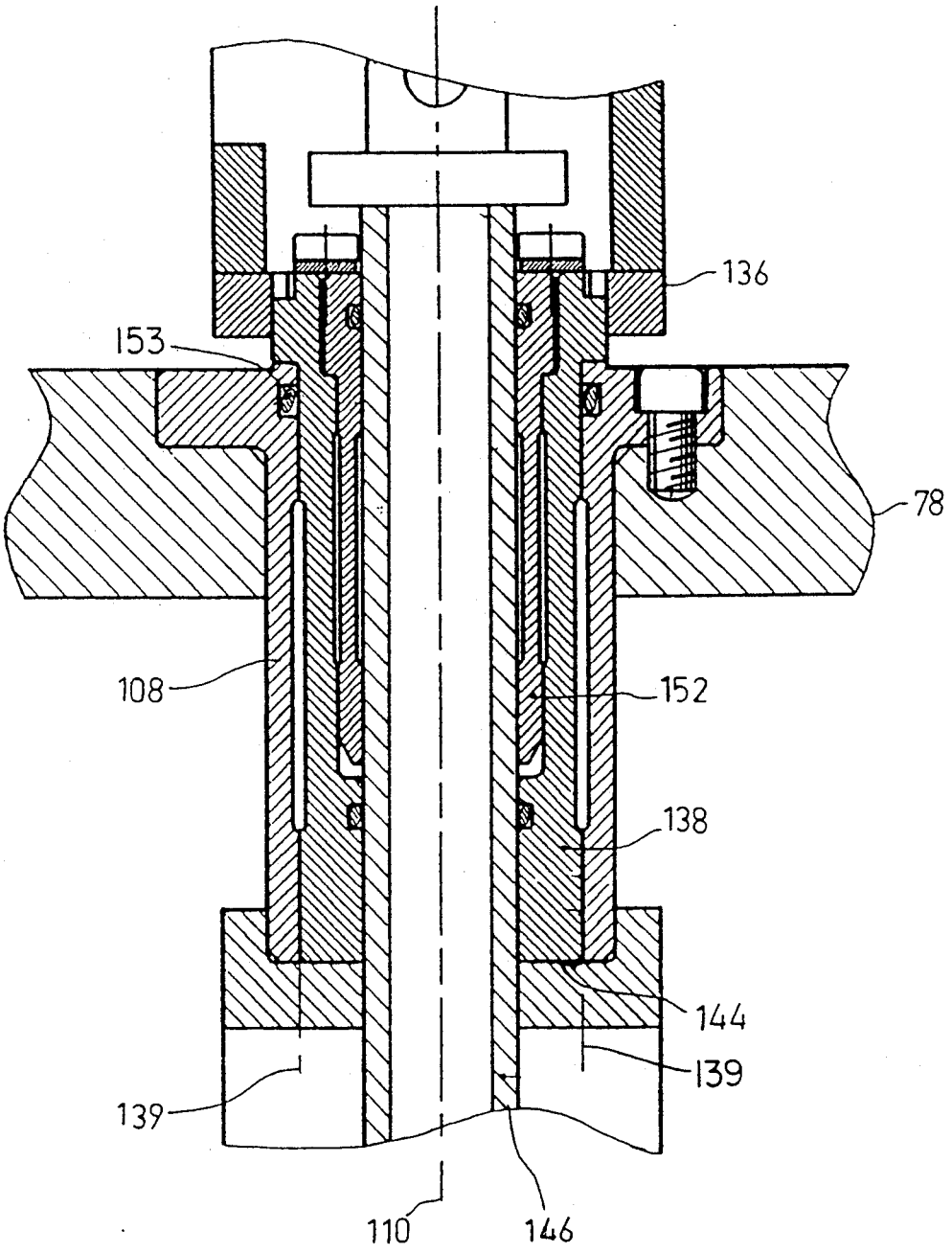

Reference is now made to FIGS. 9A and 9B which show respective side and partial sectional views of machine gun system 12 of the present invention. System 12 may be mounted onto any suitable lid or cover member, beneath which it is sought to operate a machine gun.

According to the present embodiment, however, machine gun system 12 is combined with hatch assembly 10 and is mounted onto and supported by base member 78 thereof. System 12 is operative to permit operation of a conventional machine gun, such as a well-known MAG, manufactured by FN Ltd of Belgium, or a Browning 7.62 mm, from either outside or inside the vehicle. Conventionally, machine guns are operable only from outside a tank, and thus expose the machine gunner to potential danger.

With particular reference now to FIG. 9A, system 12 includes a sleeve 108 attached to base member 78 and extending through an opening defined thereby, and defining a first or traverse axis 110. A conventional type inclined machine gun mount 112 is rotatably mounted onto sleeve 108, and defines a front portion 114 onto which is mounted a transverse support member 116 defining a second or elevation axis 118 perpendicular to traverse axis 110. A machine gun support member 120 is pivotably mounted onto transverse support 116 and includes adjustable apparatus, referenced generally 122, for damping the oscillation of the machine gun support member 120.

Apparatus 122 includes a damping element, such as a spring 123, mounted about transverse support 116 and fixed to both a member 124 mounted thereon and to the machine gun support member 120. Apparatus 122 further includes a bolt member 126 for locking a protrusion 128 of the support member 120 in any of a number of positions defined by apertures 130 of member 124, relative to the damping element, so as to adjust its damping effect on the support member 120 when a machine gun is mounted thereon.

Machine gun support member 120 defines at a rear end 132 thereof, a pair of handles 134, by which a machine-gunner is able to aim the machine gun, by tilting the machine gun support 120 either up or down, and by rotating it sideways, about traverse axis 110.

With further reference to FIG. 9B, a base portion 136 of machine gun mount 112 is positioned in axial registration with the outer sleeve 108 by means of an inner sleeve 138. Base portion 136 is fixed to sleeve 138 as by welding. Although inner sleeve 138 is held within outer sleeve 108 so as to prevent relative movement therebetween along axis 110, axial rotation of the inner sleeve 138 relative to the outer sleeve 108 is not prevented by the shown arrangement.

Handle 98 (FIG. 9A) is hingedly attached, at 140, to a downwardly extending cylindrical member 142 which is rotationally attached to a bottom portion 144 of inner sleeve 138, as by screws (not shown), provided at locations 139 (FIG. 9B). Handle 98 is also operatively associated with machine gun support member 120 via a linkage system which, according to the shown embodiment, comprises a plurality of hingedly connected rod members, referenced 145, 146, 147, 148 and 150.

Referring particularly to FIG. 9B, a sleeve 152 made of a low-friction material such as TEFLON brand PTFE is positioned between rod member 146 and inner sleeve 138, so as to ease the movement of rod member 146 along traverse axis 110. One or more O-rings 153 (one is shown in the present example) are also preferably provided so as to prevent the entry of dangerous substances from the atmosphere, such as may result from nuclear, biological or chemical warfare.

Figure 10A:
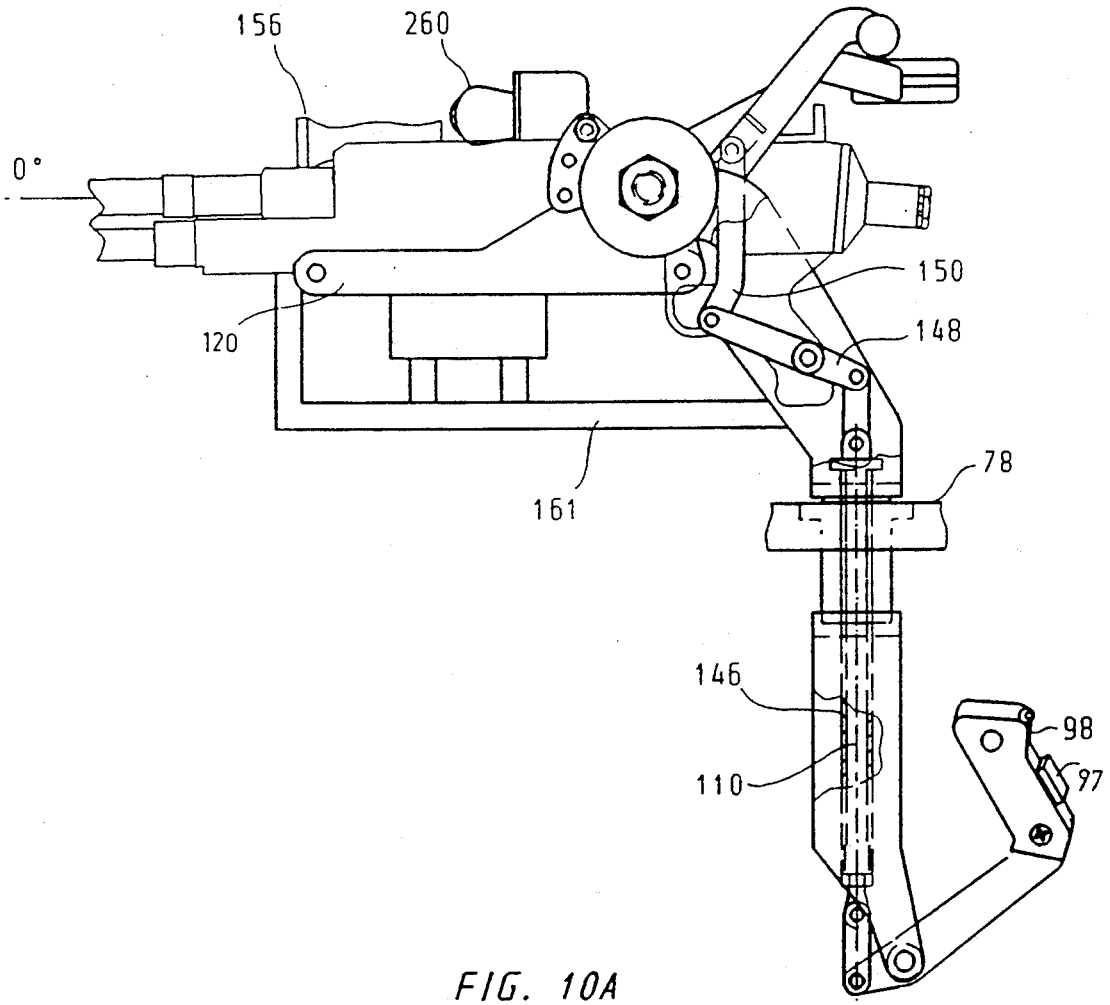
FIGS. 10A, 10B and 10C show the machine gun system of the invention, in respective horizontal, dipped and raised positions.
Figure 10B:
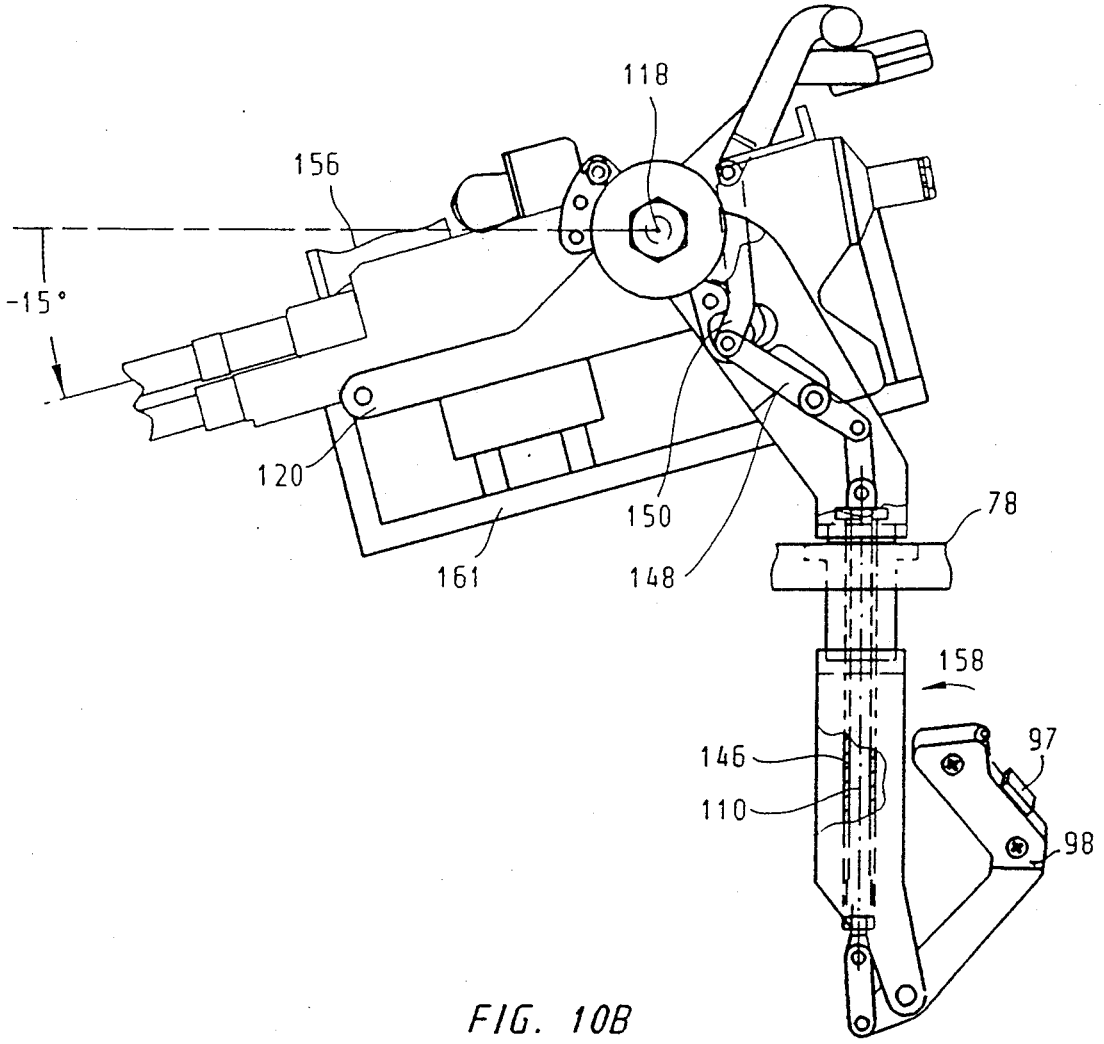
Figure 10C:
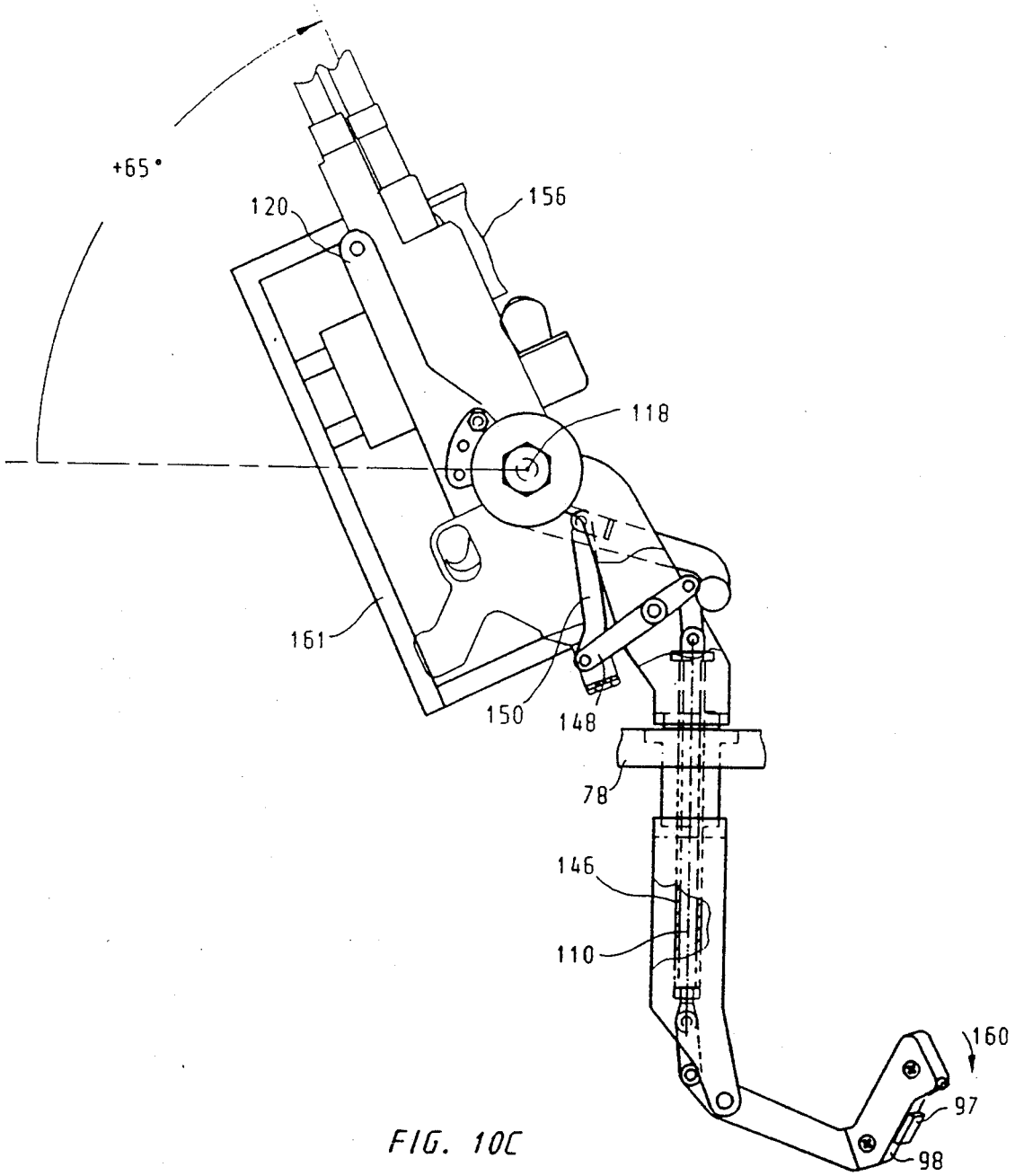
Figure 11A:
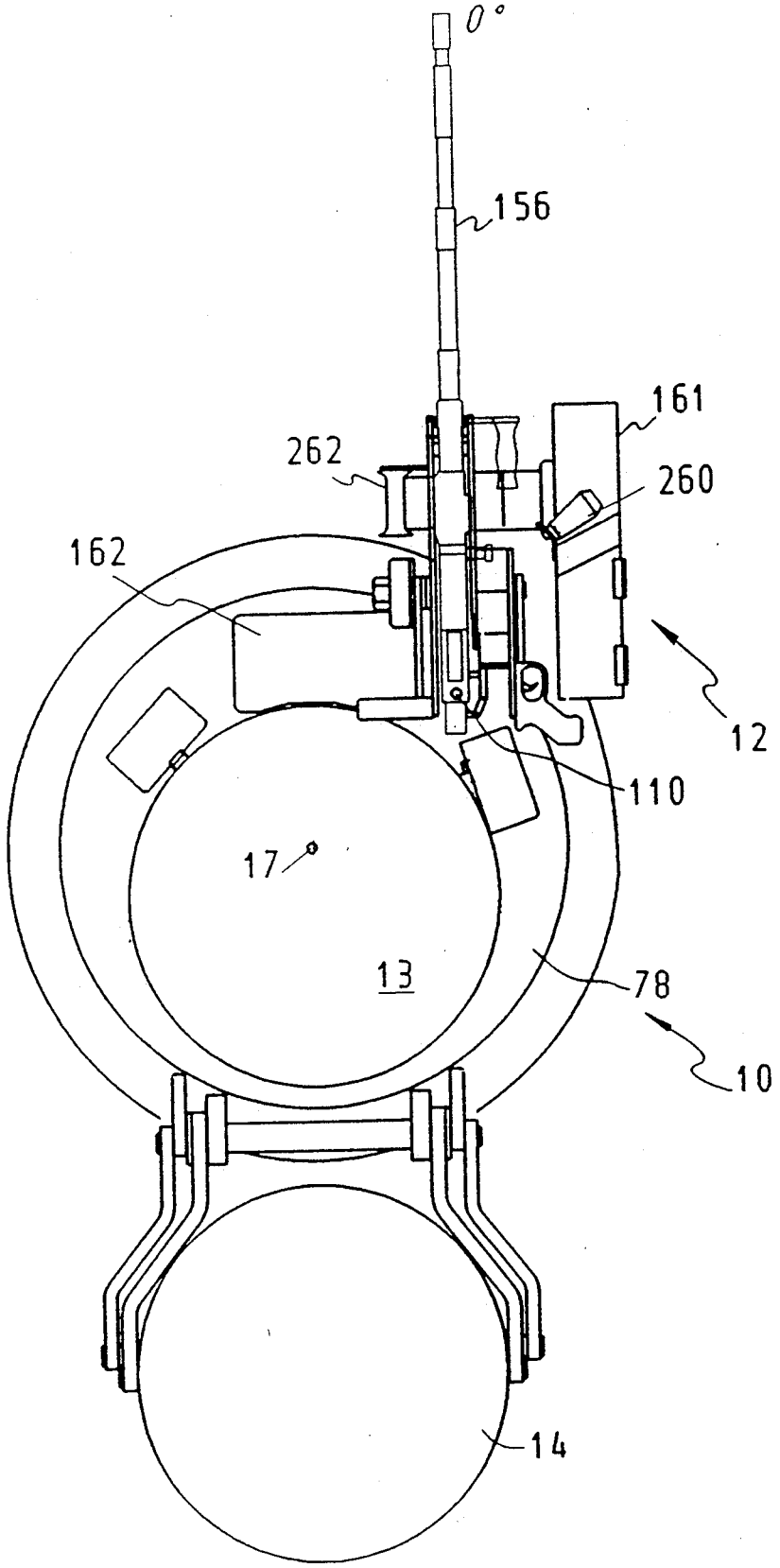
FIGS. 11A, 11B and 11C show the machine gun system of FIGS. 1A and 10A–10C, in respective forward-looking, extreme left and extreme right positions.
Figure 11B:
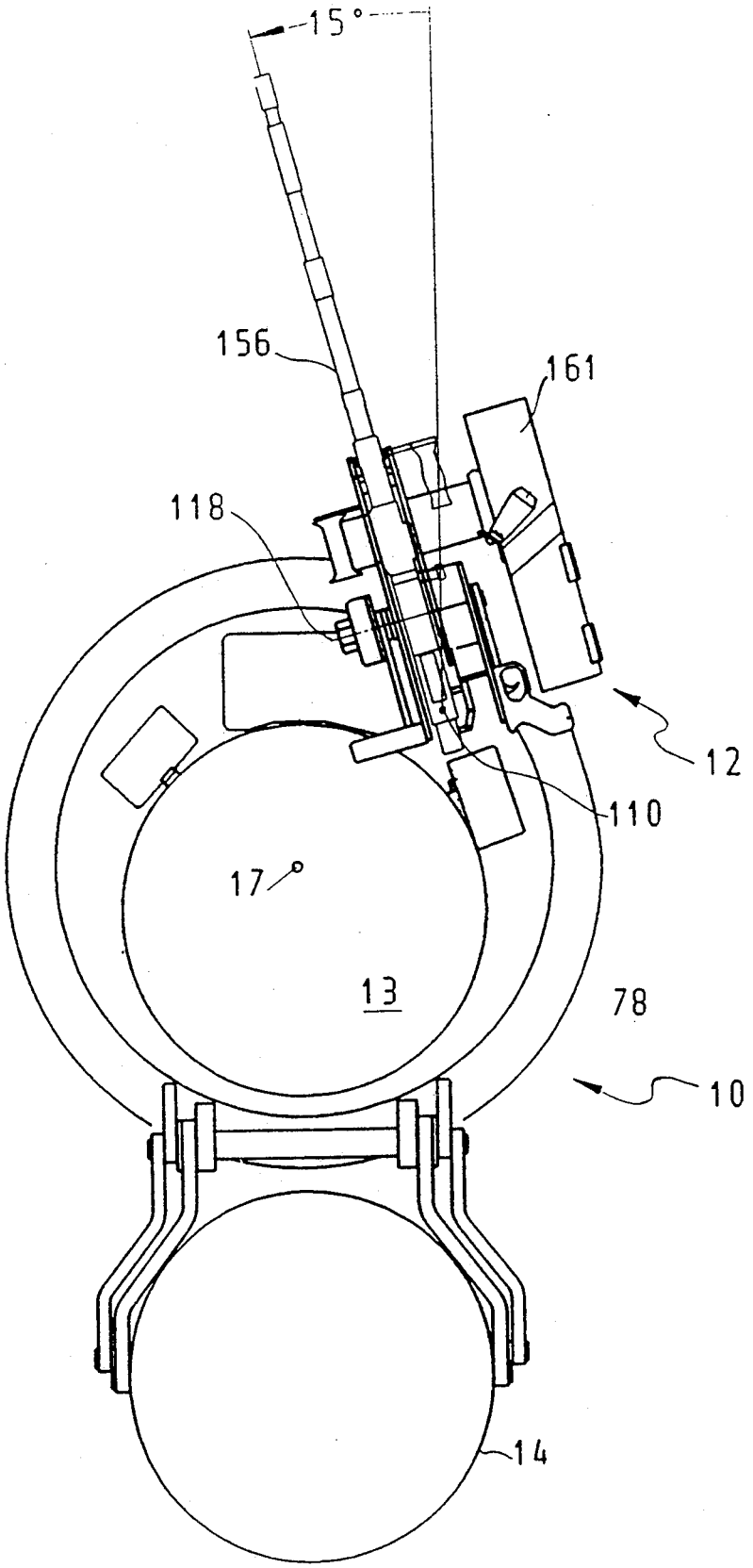
Figure 11C:
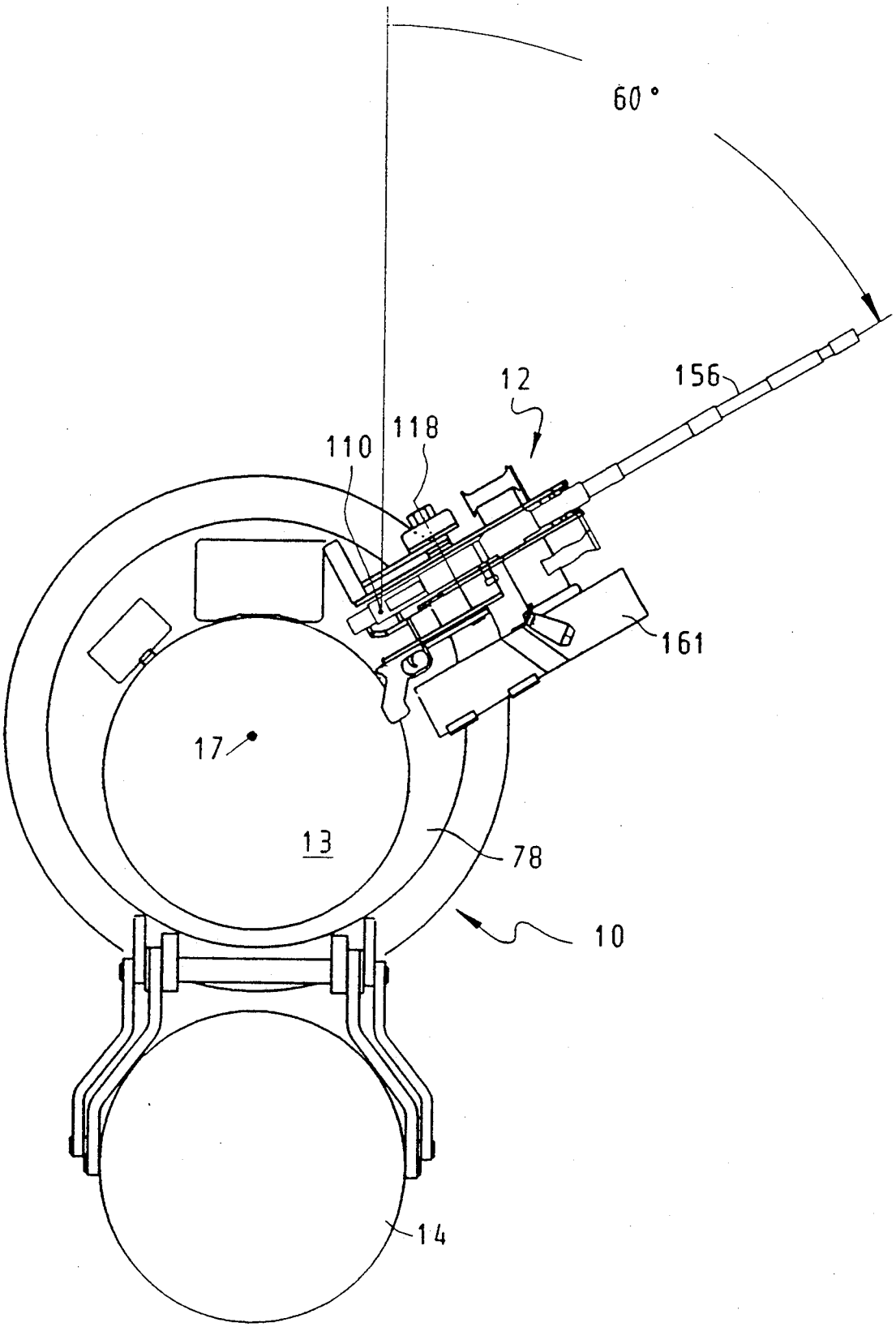

Referring additionally to FIGS. 10A–10C and to FIGS. 11A–11C, it will be appreciated that the linkage system provided between handle 98 and machine gun support 120 (FIGS. 10A–10C), comprising the hinged rod members 154, 146, 147, 148 and 150, takes into consideration human engineering factors and is, therefore, constructed such that a rearward rotational movement of handle 98 causes machine gun support 120 and, therefore, machine gun 156 to be raised, while a forward rotational movement causes machine gun support 120 and machine gun 156 to be lowered.

With particular reference to FIGS. 11A–11C, rotational movement of the machine gun support 120 and machine gun 156 relative to the hatch assembly 10 may be achieved by clockwise or anti-clockwise rotation of handle 98 (FIG. 9A) about traverse axis 110 perpendicular to base member 78, as indicated by arrows 100 and 102 (FIG. 9A).

Typical limits of movement of the machine gun support 120 are as follows:

relative to a direction parallel with the top surface of the turret (FIG. 10A):

lowered (FIG. 10B): 15°, raised (FIG. 10C): 65°, relative to a forward looking direction (FIG. 11A),
counter-clock (FIG. 11B): 15°, and
clock (FIG. 11C): 60°.

Also shown, inter alia, in FIGS. 10A–11C, is an ammunition box 161, which is configured to hold an ammunition belt containing 460 bullets or twice the number of bullets in a conventional ammunition belt.

Referring now particularly to FIG. 11A, according to the illustrated embodiment, wherein the ammunition feed 262 into the machine gun 156 is at the left side of the gun there is provided a system of rollers 260 and a channel (not shown) which extends beneath the machine gun and guides the ammunition belt from the ammunition box 161 located to the right of the gun, beneath the gun, and permits left side feeding of the belt into the gun. The ammunition box 161 is located, in the present embodiment, to the right of the machine gun 156, so as not to interfered with the line of sight of a periscopic sight 162 of the machine gun system.

According to an alternative embodiment, however, the ammunition box 161 may be located to the left of the machine gun. In this case, a system would be provided wherein the ammunition is fed over periscopic sight 162.

Figure 12A:
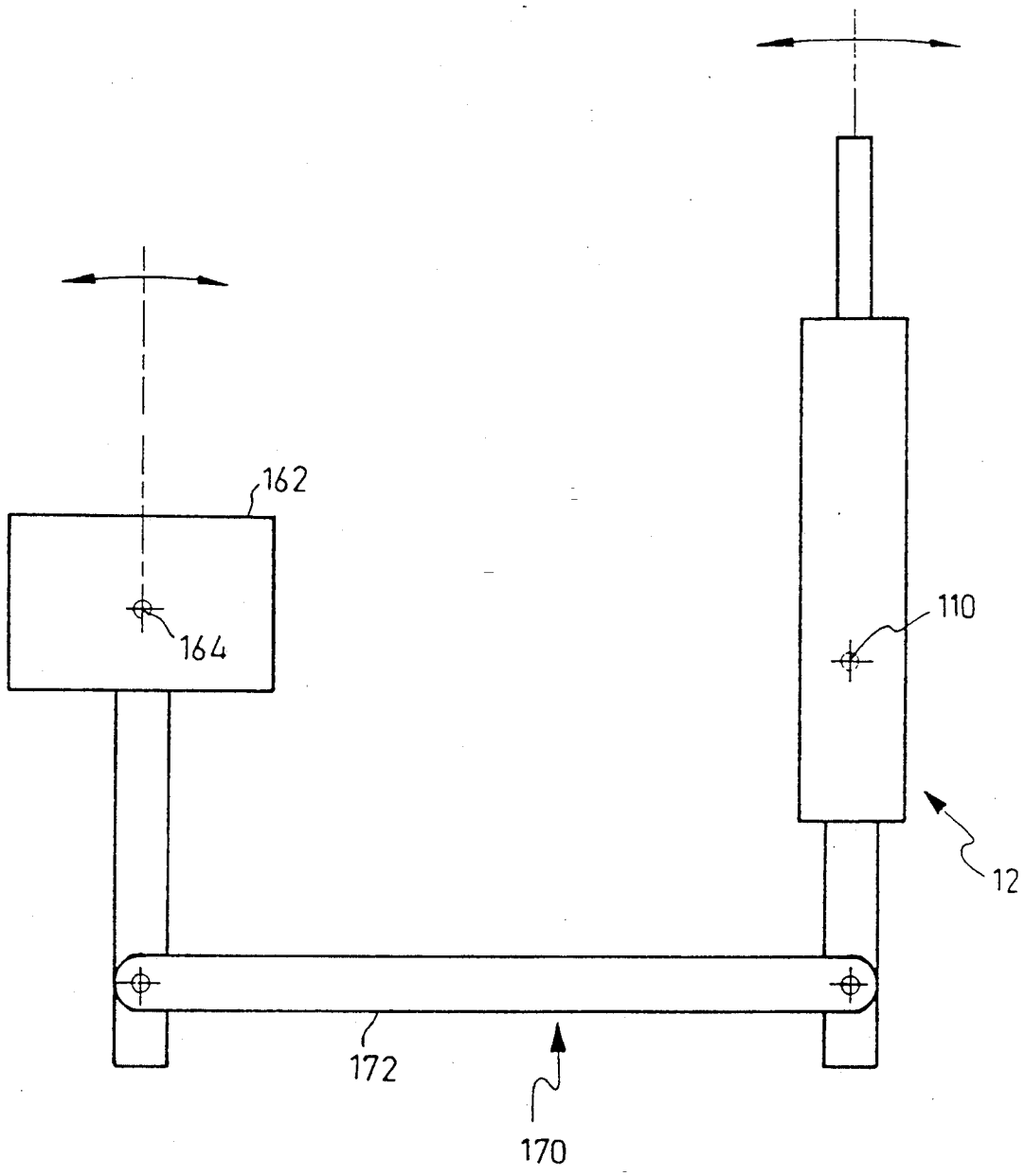
FIGS. 12A and 12B show, in schematic fashion, respective side and plan views of the machine gun sight, the machine gun support of the present invention, and apparatus for slaving the machine gun support to the gun sight.
Figure 12B:
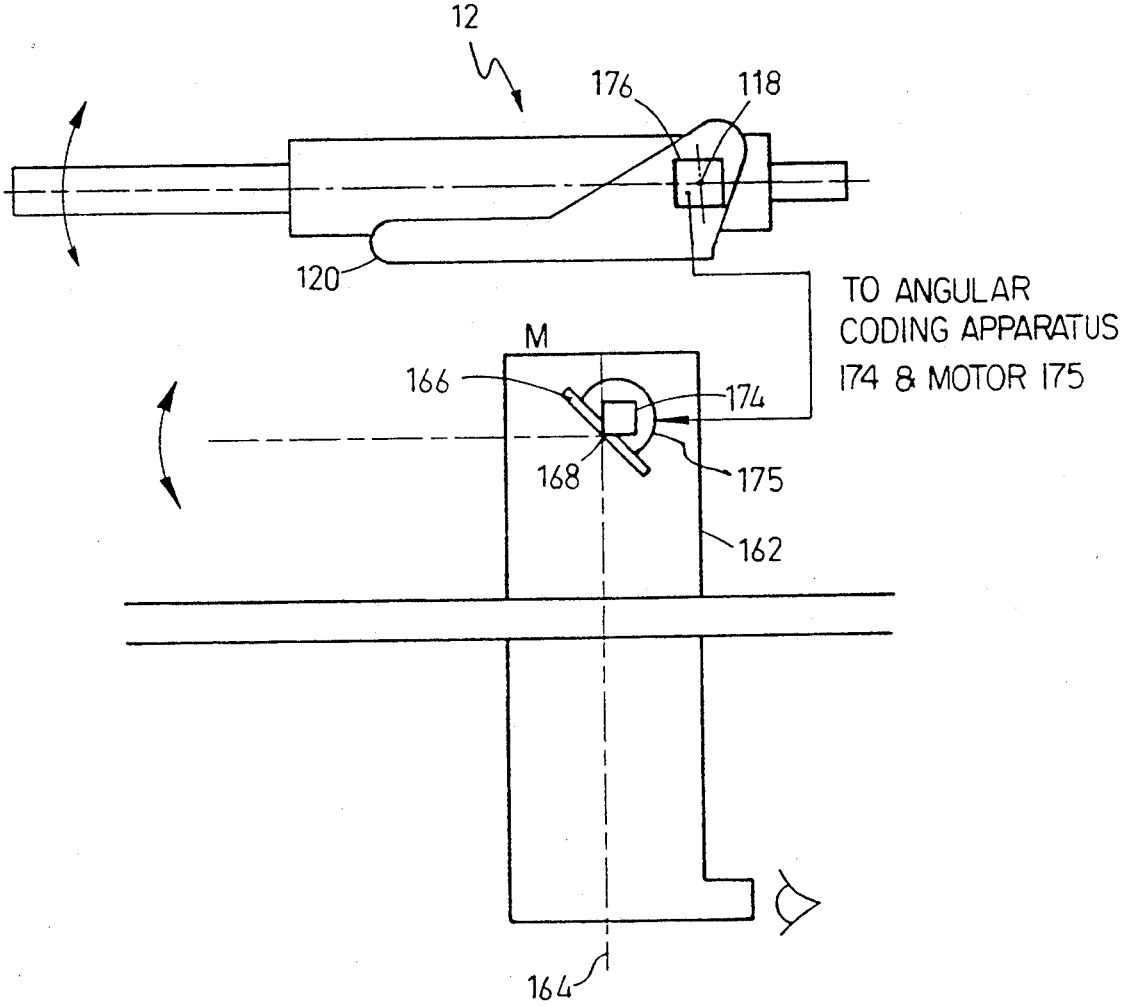

Referring now to FIGS. 12A and 12B, there are shown, in schematic form, a machine gun sight 162, the machine gun system 12 of the present invention, and apparatus for slaving the machine gun support 120 to the periscopic sight 162. Sight 162 may be any suitable periscopic sight, mounted for rotation about a generally vertical, third axis 164, parallel to traverse axis 110. An upper reflective element 166 (FIG. 12B) of the periscopic sight is pivotable about a generally horizontal, fourth axis 168, parallel to elevation axis 118.

It will be appreciated that in order to provide accurate aiming of the machine gun, it is necessary to slave the machine gun support 120 to sight 162. Slaving in a generally horizontal plane with respect to traverse axis 110 and third axis 164 may be provided by means of a mechanical system 170 (FIG. 12A), such as may include a single rigid rod 172 hingedly connected to both the machine gun support and to the sight.

Figure 15B:
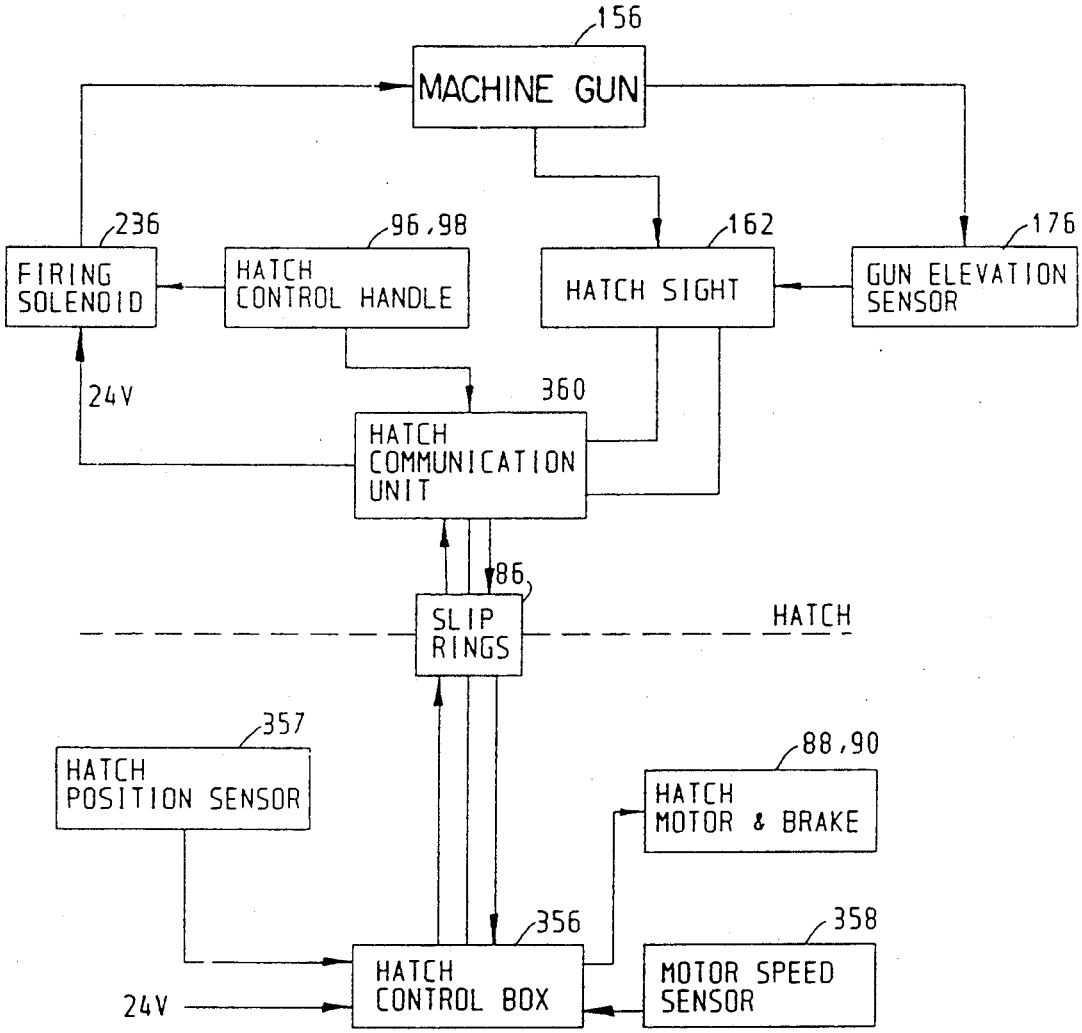
FIG. 15B is a block diagram illustration of control and monitoring systems of the apparatus of the present invention incorporated into an armored vehicle other than a battle tank.

Slaving in a generally vertical plane with respect to elevation axis 118 and fourth axis 168 is typically provided by means of first angular encoding apparatus 174, such as a potentiometer, and a motor 175, both associated with the upper reflective element 166 of the sight, and second angular encoding apparatus 176 associated with the machine gun support 120. Signals are provided to the first angular encoding apparatus 174 and motor 175 by the second angular encoding apparatus 176 upon movement of the machine gun support 120 with respect to elevation axis 118. With reference also to FIGS. 15A and 15B, signals are conducted between the angular encoders 176 and 174, respectively associated with machine gun 156 and sight 162, via slip rings 86 (also FIG. 5) and connectors 82 and 84 (FIG. 5) associated respectively with the turret and the hatch. As indicated further in FIG. 15A, a backup connection may also be provided by quick coupling connection apparatus 163.

Figure 13A:
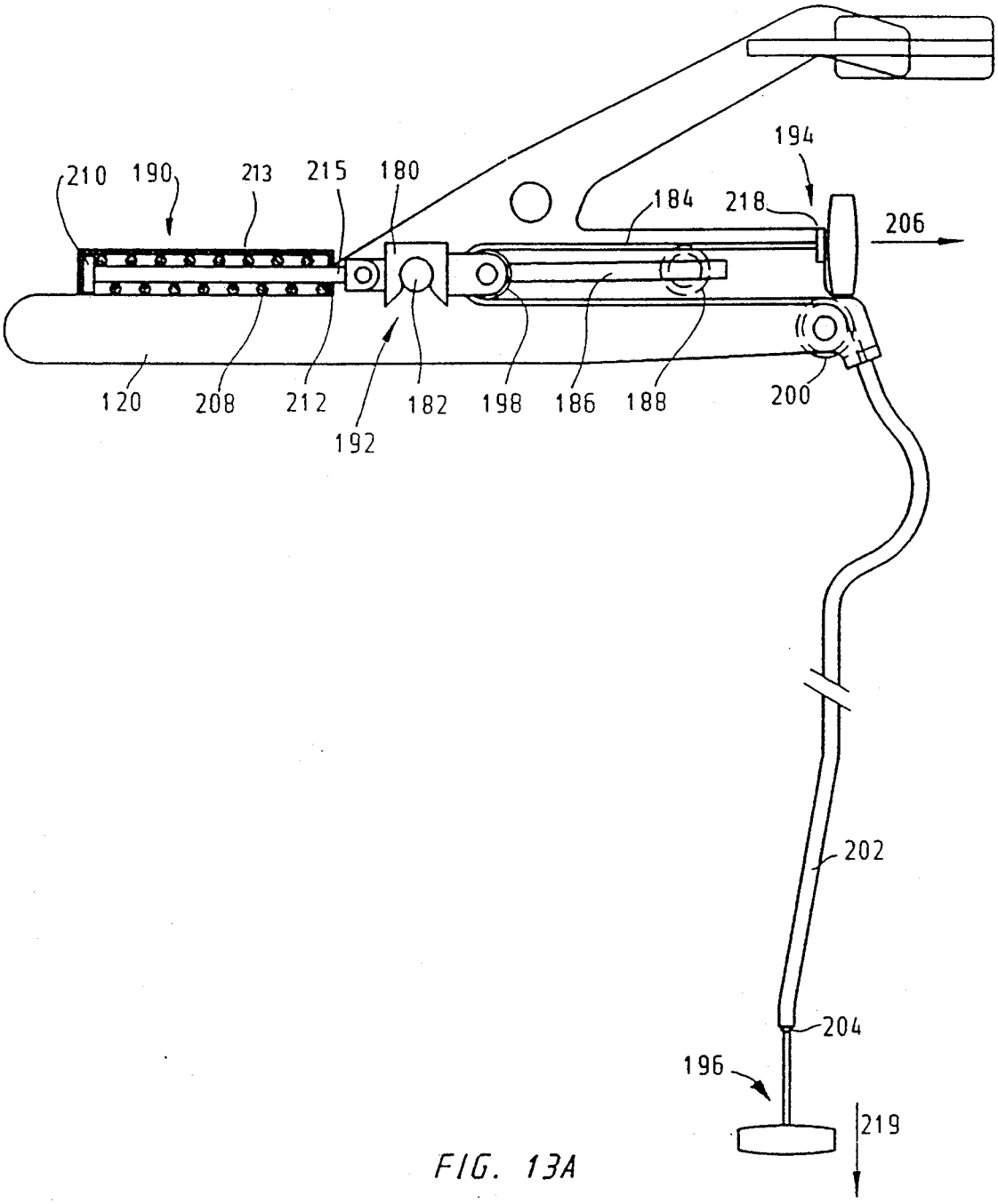
FIGS. 13A and 13B are respective partial and full views of the machine gun system of FIGS. 10A and 10B, and including details of apparatus for cocking the machine gun.
Figure 13B:
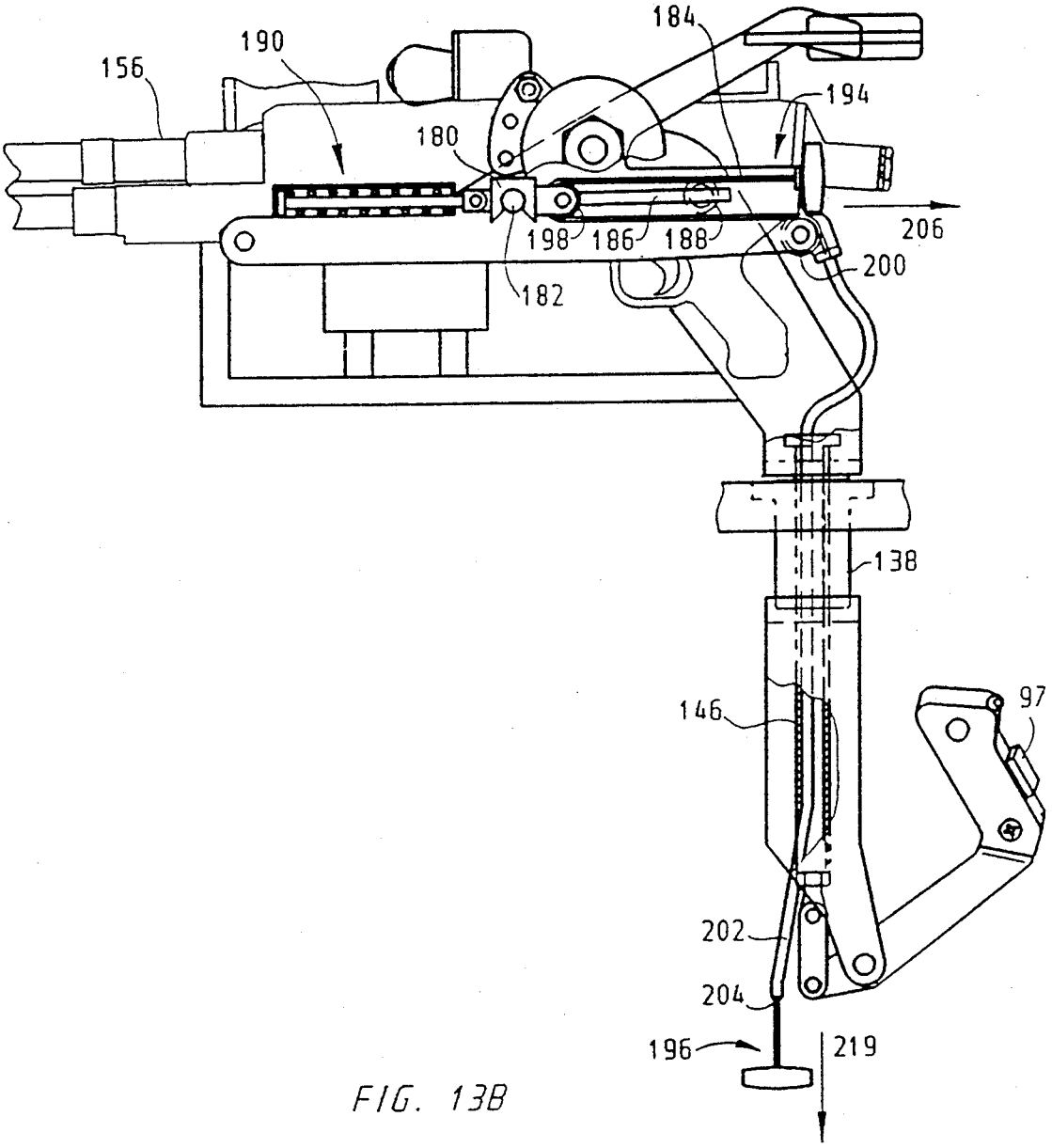

Reference is now made to FIGS. 13A and 13B, which are respective partial and full views of the machine gun system 12 of the invention, but also including details of apparatus for cocking machine gun 156.

The cocking apparatus includes a slidable cocking member 180 for engaging a cock portion 182 of the machine gun, and a member 184 for displacing the cock portion 182 along a track 186 towards a rear position 188 so as to cock the machine gun. There is also provided apparatus 190 for returning the cock portion 182 towards its original position 192 along track 186. Member 184 is, in the illustrated embodiment, a cable having handles at respective first and second ends, 194 and 196, arranged for use from outside and inside of the vehicle respectively. Cable 184 extends from first end 194, in a direction generally parallel to track 186, around a pulley member 198 rotatably mounted onto cocking member 180, so as to return towards a rear-mounted pulley 200. Cable 184 extends around pulley 200 and into the interior of the vehicle so as to terminate at second end 196.

The portion of the cable 184 extending into the interior of the vehicle is typically protected by a fixed sheathing 202. It will be appreciated that the rearward displacement of cock portion 182, required to cock the machine gun, is provided by pulling on either of the first or second handles. Stop members are therefore also required, so as to provide anchorage to the cable. A first stop member 204 is attached to the cable adjacent the second end 196, stop member 204 having a diameter larger than the internal diameter of the sheathing 202.

When, therefore, cable 184 is pulled by the handle at first end 194, in the direction indicated by arrow 206, the cable becomes anchored by first stop member 204 being pulled against sheathing 202 and the effect of the pulling of the first handle is, therefore, to compress a compression spring 208 so as to cause displacement of cock portion 182 in the desired rearward direction so as to cock the machine gun.

Return of cock portion 182 to its original position 192 is provided by apparatus 190 of which compression spring 208 is confined between an end flange 210 of rod extension 215 of cocking member 180, and a rear wall 212 of a fixed housing 213.

A second stop member adjacent to the first end 194 is defined by flanges 218 mounted onto machine gun support 120, as shown. When, therefore, cable 184 is pulled by handle at second end 196, in the direction indicated by arrow 219, the cable becomes anchored by the first-end handle being pulled against flanges 218. The effect of the pulling of the second-end handle is, therefore, to displace cock portion 182 in the desired rearward direction so as to cock the machine gun, while also compressing spring 208. Return of cock portion 182 to its original position 192 is as described above.

Referring particularly to FIG. 13B, and according to a preferred embodiment of the invention, rod member 146 is hollow, and sheathing 202 is thus arranged therewithin and also within inner sleeve 138.

Figure 14A:
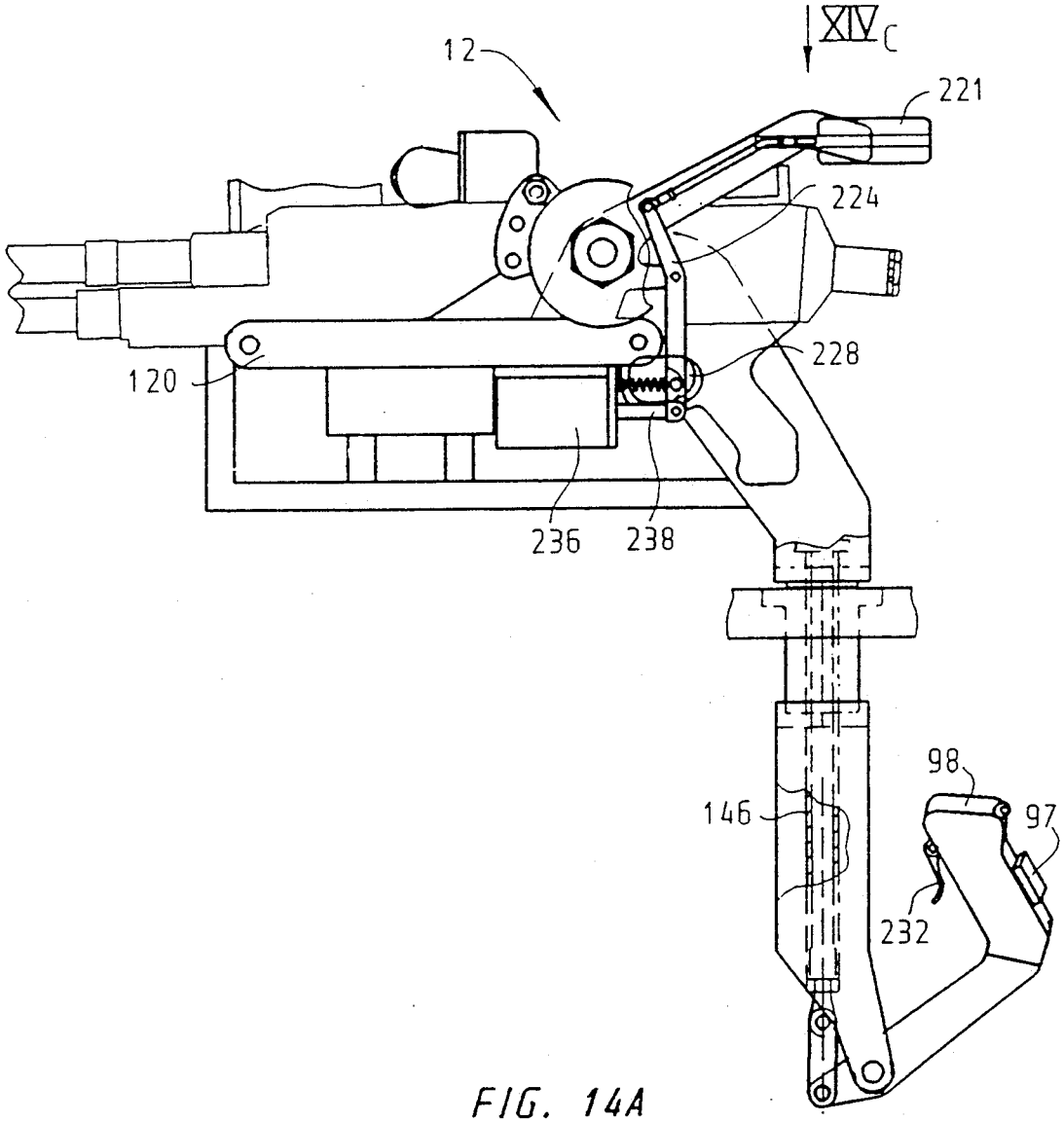
FIGS. 14A, 14B and 14C are respective side, detailed partial side and detailed partial top views of the machine gun system of FIGS. 10A and 10B, and including details of apparatus for firing the machine gun both from inside and outside of the vehicle.
Figure 14B:
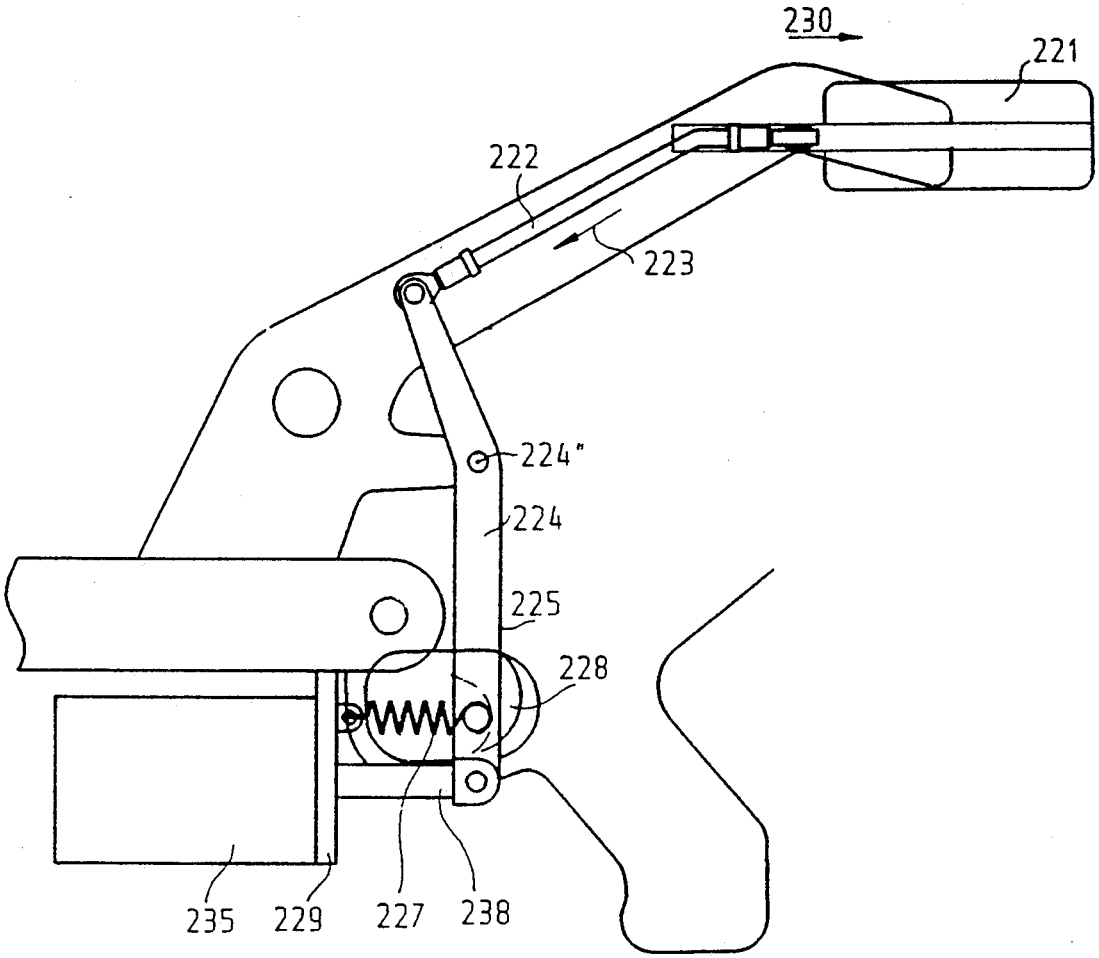
Figure 14C:
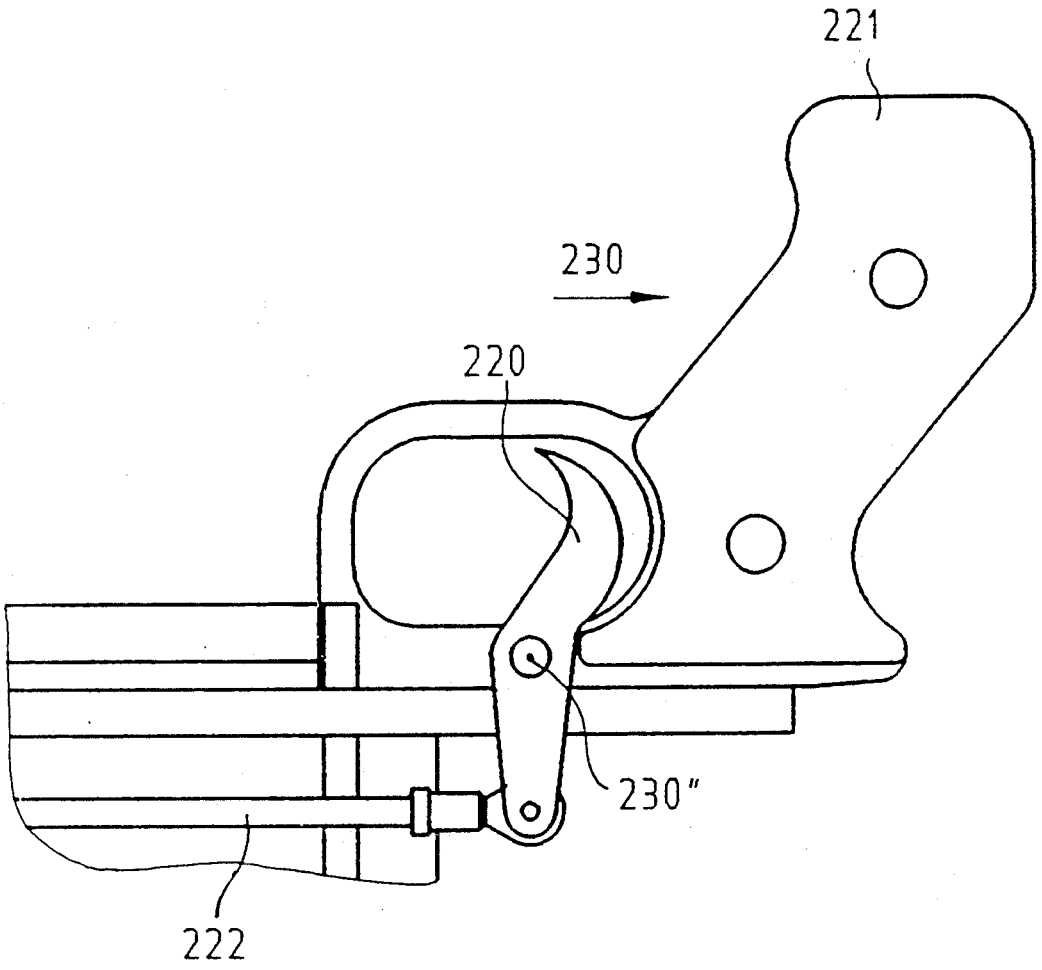

Reference is now made to FIGS. 14A, 14B and 14C, which shows various views of the machine gun system 12 of the present invention, and including details of apparatus for firing the machine gun both from inside and outside of the vehicle.

The apparatus includes a manual trigger 220 (FIG. 14C), associated with a handle 221 and mounted on an upper portion of the gun support 120. The manual trigger is associated with the gun trigger 228, as shown, by a system of hinged rods, referenced 222 and 224. This is shown most clearly in FIG. 14B. As manual trigger 220 is depressed in the direction indicated by arrow 230 (FIG. 14C) so as to be pivoted about an axis 230'' (FIG. 14C), rod 222 is displaced in a forward direction, as indicated by arrow 223 (FIG. 14B), so as to cause pivoting of rod 224 about axis 224'' such that a lower portion 225 of rod 224 engages and depresses gun trigger 228.

As rod 224 is pivoted as described, it extends a tension spring 227, attached to a fixed flange 229 and portion 225 of the rod 224. As soon as the manual trigger 220 (FIG. 14C) is released, the tension spring 227 causes a reverse movement of hinged rods 222 and 224 to the initial position illustrated in FIGS. 14B and 14C.

According to the present embodiment, operation of the machine gun from inside the vehicle is facilitated by an electromechanical system, which includes an electrical trigger 232 connected to a solenoid 236 via an electrical cable (not shown) extending through rod member 146, and a solenoid operated element 238 for depressing the gun trigger 228 via portion 225 of rod 224. For convenience, the electrical trigger 232 is mounted onto handle 98 (FIG. 14A). As with the externally operated manual firing of the machine gun by use of manual trigger 220, tension spring 227 is operative to cause the return element 238 after firing.

According to one embodiment of the invention, grip catch 97, which is provided as a safety catch so as to permit rotation of the hatch assembly 10 of the invention (FIGS. 1A-8), may also function as a safety catch for the machine gun system 12. Alternatively, a separate safety catch for the machine gun system may be provided.

Figure 18:
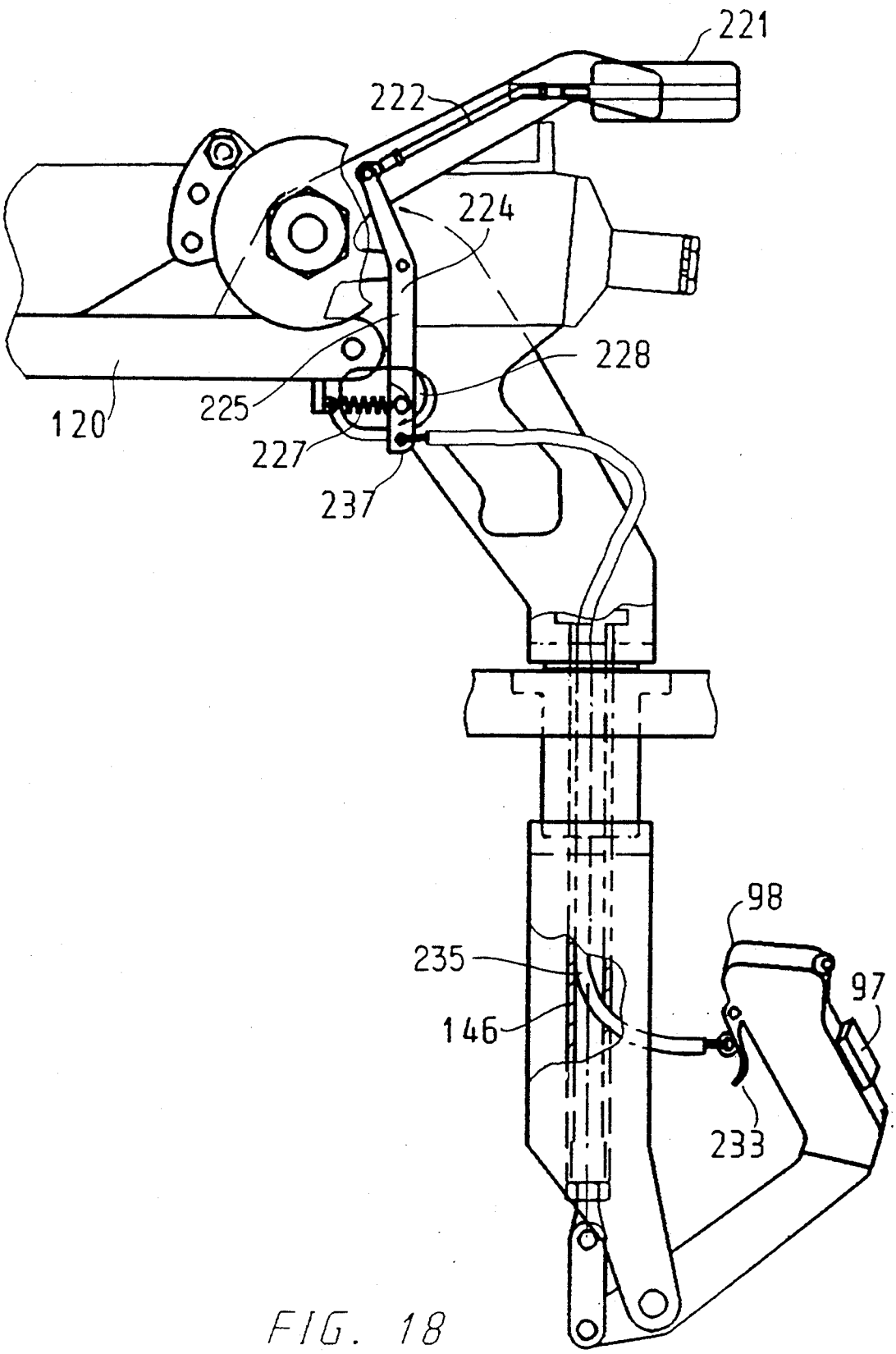
FIG. 18 is a side view illustration of the machine gun system, corresponding to the view of FIG. 14A, but constructed in accordance with an alternative embodiment of the invention.

Referring now to FIG. 18, there is illustrated a mechanical system for firing the machine gun from inside the vehicle, constructed in accordance with a further embodiment of the invention. The mechanical system may be employed in place of the system shown and described above in conjunction with FIGS. 14A-14C, or in addition thereto. Although the firing system shown in FIG. 18 does not include the electrical apparatus of FIGS. 14A-14C, this is only for the sake of simplicity and is not intended to exclude the combined installation of both the mechanical and the electrical systems.

The mechanical firing system includes a trigger 233 mounted onto handle 98 and to which is attached one end of a firing cable 235. The firing cable may extend through rod member 146 and be connected at its other end to portion 237 of hinged rod 224. As shown and described above in conjunction with FIGS. 14A-14C, gun trigger 228 is operative to be depressed by rearward movement of hinged member 224, so as to provide firing of the machine gun.

According to an embodiment wherein the mechanical system illustrated in FIG. 18 is combined with the electromechanical system illustrated in FIGS. 14A and 14B, respective triggers 233 and 232 may either both be provided, or a single trigger may be provided to operate both systems.

Reference is now made to FIG. 15A, which is a block diagram illustration of control and monitoring systems of the apparatus of the present invention when incorporated into a battle tank, wherein the control and monitoring systems can be divided into the following: existing tank systems, referenced 335; systems, referenced 337, directly associated with the hatch and receiving input from a human operator, for example, the tank commander; and monitoring systems, referenced 339 which are located in the hatch and which interface with both the existing tank systems and those directly associated with the hatch.

The existing tank systems include a turret control system 340 which receives input, inter alia, from apparatus 342 for measuring the angular displacement between the hull and turret of the tank, taken in a plane perpendicular to the axis of rotation of the turret. In addition, turret control system 340 also receives input from a main gun elevation sensor 344.

Located in the turret is a hatch control box 346, which interfaces with the turret control system 340 and receives input from apparatus 347 for sensing the rotational position of the hatch assembly 10. Control box 346 is also operative to send out command signals to the hatch assembly motor 88 and to receive input from a sensor 348, operative to detect the speed of the hatch motor.

Communicating with the hatch control box 346 are, as described, various systems directly associated with the hatch and receiving input from a human operator, for example, the tank commander. The signals transmitted between the hatch control box and the various hatch systems are gathered by a hatch communications unit 350, and are transmitted between unit 350 and hatch control box 346 via the slip rings 86.

The systems directly associated with the hatch include the following:

1. the hatch control handle 98 and the switch 96 mounted thereon;
2. the hatch sight 162 (FIG. 12B); and
3. the machine gun elevation sensor 176 (both in FIG. 12B), and the firing solenoid 236 (FIG. 14A), which form part of the machine gun system 12. Other systems described above as operating the machine gun are primarily manual systems.

With further reference to FIG. 15A, there is also provided an optional connection between the hatch sight 162 and the turret control system 340. This is indicated by broken line 351. The provision of such a connection enables the main gun to be slaved to the hatch sight in preference to the main gun sight.

Reference is now made to FIG. 15B, which is a block diagram illustration of control and monitoring systems of the apparatus of the present invention when incorporated into an armored vehicle other than a battle tank, such as a halftrack. In the present embodiment, some of the control and monitoring systems may be similar to those shown and described above in conjunction with FIG. 15A as being present in a tank application.

In summary, therefore, the control and monitoring systems in the present embodiment include a hatch control box 356, which receives input from apparatus 357 for sensing the rotational position of the hatch assembly 10 relative to the remainder of the vehicle. Control box 356 is also operative to send out command signals to the hatch assembly motor 88 and to receive input from a sensor 358, operative to detect the speed of the hatch motor.

Communicating with the hatch control box 356 are various systems which are controlled directly by a human operator, for example, the vehicle commander. The signals transmitted between the hatch control box and the various hatch systems are gathered by a hatch communications unit 360, and are transmitted between unit 360 and hatch control box 356 via the slip rings 86.

The systems directly associated with the hatch include the following:

1. the hatch control handle 98 and the switch 96 mounted thereon;
2. the hatch sight 162 (FIG. 12B); and
3. the machine gun elevation sensor 176 (both in FIG. 12B), and the firing solenoid 236 (FIG. 14A), which form part of the machine gun system 12. Other systems described above as operating the machine gun are primarily manual systems.

Figure 17:
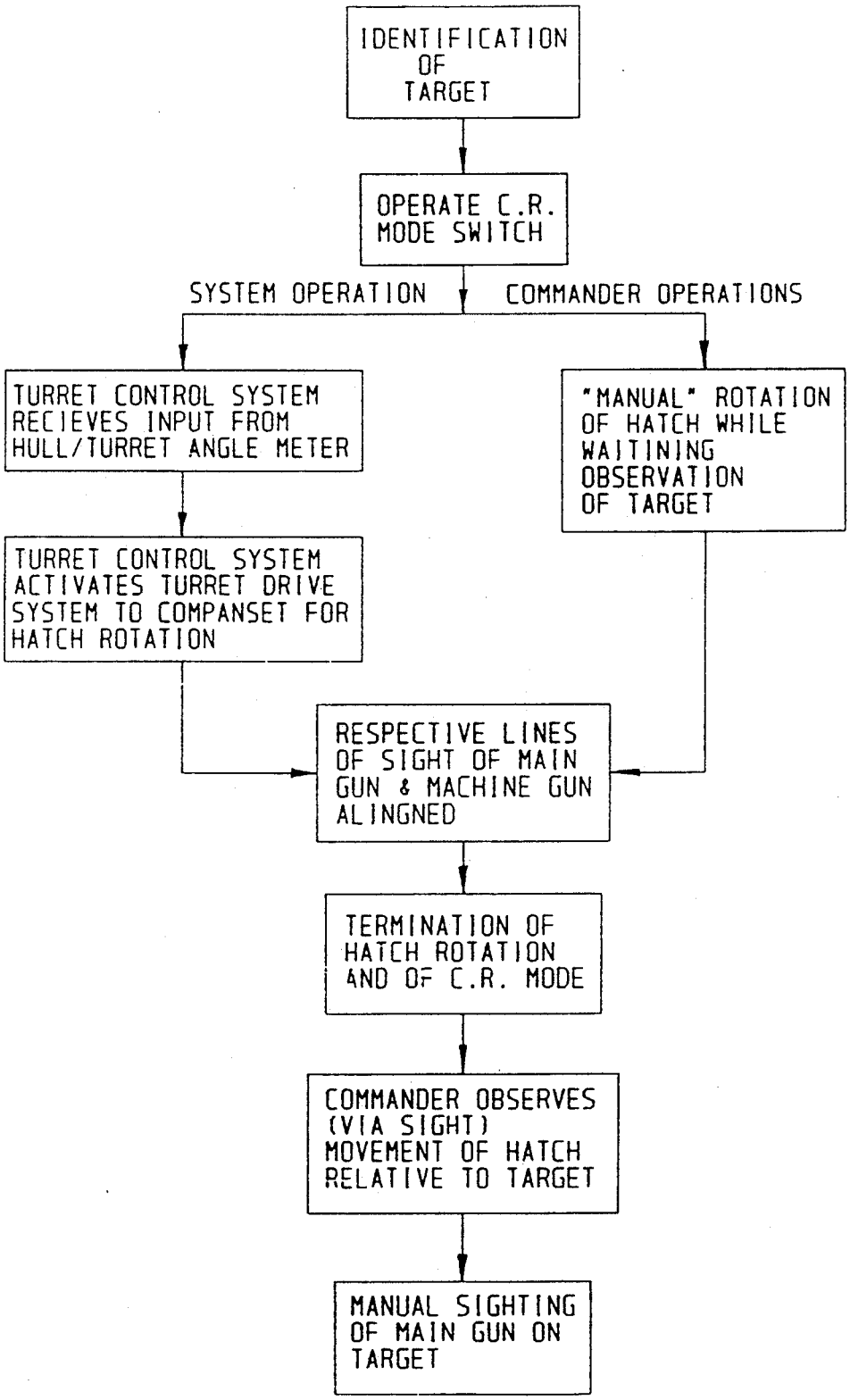
FIG. 17 is a flow chart illustrating the operation of the apparatus shown in FIG. 16 in counter rotation mode.

Reference is now made to FIGS. 16 and 17. FIG. 16 is a plan view of a battle vehicle including the hatch assembly of the present invention, wherein the sight 162 associated with the machine gun 156 is directed towards a target. It will be appreciated that in the present embodiment the 'hatch' is, in fact a command hatch, although the mode of operation described below is equally applicable to any hatch constructed according to the present invention.

Indicated in solid lines is the position of the turret at commencement of a 'counter rotation' mode, wherein it is required to bring the main gun 252 from the illustrated solid line position into a position in which its line of sight is parallel to that of the sight 162. In this position, it will be appreciated, the line of sight of the main gun 252 will thus also be directed at the target. In order to achieve this, the turret 254 must be rotated, as indicated by solid arrow 256, while rotating the hatch assembly 10 in an opposing direction, indicated by broken arrow 258, so as to retain alignment of sight 162 with the target. The final positions of the turret and of the hatch assembly are illustrated by broken lines.

Once a target has been identified via machine-gun sight 162, a mode switch (not shown) associated with the hatch control box 346 (FIG. 15A) is activated. In this 'counter-rotation' mode, a signal is sent to the turret control system 340 (FIG. 15A) to implement the counter-rotation mode.

In this mode, initially, the turret is rotated about axis 400 (FIG. 16) under the control of the conventional turret control system 340 (FIG. 15A). Simultaneously, the vehicle commander rotates hatch assembly 10 about axis 17, as by switch 96 (FIG. 6), in a direction opposite to the direction of rotation of the turret while manually ensuring that the machine gun sight is maintained in alignment with the target. The rotation of the hatch is preferably carried out at the same angular velocity as that at which the turret is rotated.

The turret control system is provided with appropriate control software and/or hardware so as to determine when the angular displacement between the turret and hatch assembly has been reduced to zero. At this position, as the line of sight of the machine gun sight has been maintained in its position directed toward the target, the respective lines of sight of the main gun 252 and the machine gun 156 are in alignment, and the turret control system 340 (FIG. 15A) issues a command to halt the rotation of the turret.

It will be appreciated by persons skilled in the art, that the scope of the present invention is not limited to what has been particularly shown and described hereinabove by way of example. The scope of the invention is limited, rather, solely by the claims, which follow.

We claim:

1. A hatch assembly for an armored vehicle comprising:

base means mounted onto an upper portion of the vehicle and having inner and outer portions, said inner portion defining a hatch opening;

a hatch cover associated with said hatch opening;

means for mounting said hatch cover onto said outer portion of said base means and enabling rotation of said hatch cover between first and second extreme positions, said hatch cover closing said hatch opening when in said first extreme position, and resting on an adjacent portion of the upper portion of the vehicle when in said second extreme position; and means for permitting relative rotation between said inner portion of said base means and said hatch cover when said hatch cover is not in said first extreme position.

2. A hatch assembly according to claim 1, and wherein said means for permitting relative rotation comprises means for permitting relative rotation of 360° between said inner portion of said base means and said hatch cover.

3. A hatch assembly according to claim 1, and wherein said hatch opening is a first opening and said outer portion of said base means defines a second opening at least partially overlapping said first opening, said inner portion of said base means comprising an annular member associated with said second opening and defining said first opening, and said means for permitting relative rotation comprises:

circular track means disposed between said outer portion and said annular member of said base; and means for selectably locking said annular member to said outer portion, said relative rotation being permitted when said means for locking is not operated, and being prevented, when said means for locking is operated.

4. A hatch assembly according to claim 3, and wherein said circular track means comprises an inner track member rotationally associated with said annular portion, and coaxially mounted within an outer track member associated with said outer portion of said base means.

5. A hatch assembly according to claim 4, and wherein said circular track means also comprises:

a circular track member mounted onto the upper portion of the vehicle and defining inner and outer coaxial engagement portions associated with said inner track member and said outer track member respectively;

inner bearing means disposed between said inner engagement portion and said inner track member; and outer bearing means associated with said outer track member.

6. A hatch assembly according to claim 1, and wherein said base means comprises circular base means rotatably mounted onto the upper portion of the vehicle.

7. A hatch assembly according to claim 1, and wherein said means for mounting comprises a four-bar mounting system operative to permit rotation of said hatch cover between said first and second extreme positions along a predetermined rotation arc, such that at every point along said rotation arc said hatch cover has a predetermined angular orientation relative to said outer portion of said base means.

8. A hatch assembly according to claim 7, and wherein said four-bar mounting system comprises:

mounting means mounted onto said outer portion of said base means and defining first and second axes generally parallel to an upper surface of the vehicle;

a first, inner pair of elongate members defining respective first end portions mounted for rotation about said first axis, and also defining respective second end portions attached to said hatch cover for pivoting about a third axis associated therewith, said third axis being parallel to said first and second axes; and a second, outer pair of elongate members defining respective first end portions mounted for rotation about said second axis, and also defining respective second end portions attached to said hatch cover for pivoting about a fourth axis associated therewith and parallel to said third axis.

said first, second, third and fourth axes defining the vertices of a parallelogram, thereby defining said predetermined rotation arc of said hatch cover between said first and second extreme positions.

9. A hatch assembly according to claim 8, and also including means for locking said hatch cover in any of a plurality of predetermined positions along said predetermined rotation arc.

10. A hatch assembly according to claim 9, and wherein said means for locking comprises a single locking member for lockably engaging said hatch cover with predetermined portions of a predetermined pair of members selected from the following group:

said first pair of elongate members; and said second pair of elongate members.

11. A hatch assembly according to claim 10, and wherein said means for locking comprises means for locking said hatch to a predetermined one of said first pair of elongate members.

12. A hatch assembly according to claim 1, and wherein said inner portion of said base means also comprises means for supporting machine gun apparatus.

13. A hatch assembly according to claim 12, and wherein said base means defines upper and lower sides and said means for supporting machine gun apparatus is mounted onto said upper side of said base means, and said hatch assembly also comprises means, associated with said base means, for operating said machine gun apparatus from said lower side of said base means.

14. An armored vehicle having a hatch assembly which comprises:

base means mounted onto an upper portion of said vehicle and having inner and outer portions, said inner portion defining a hatch opening;

a hatch cover associated with said hatch opening;

means for mounting said hatch cover onto said outer portion of said base means and enabling rotation of said hatch cover between first and second extreme positions, said hatch cover closing said hatch opening when in said first extreme position, and resting on an adjacent portion of the upper portion of the vehicle when in said second extreme position; and means for permitting relative rotation between said inner portion of said base means and said hatch cover when said hatch cover is not in said first extreme position.

15. An armored vehicle according to claim 14, and wherein said means for permitting relative rotation comprises means for permitting relative rotation of 360° between said inner portion of said base means and said hatch cover.

16. An armored vehicle according to claim 15, and wherein said hatch opening is a first opening and said outer portion of said base means defines a second opening at least partially overlapping said first opening, said inner portion of said base means comprising an annular member associated with said second opening and defining said first opening, and said means for permitting relative rotation comprises:

circular track means disposed between said outer portion and said annular member of said base; and means for selectably locking said annular member to said outer portion, said relative rotation being permitted when said means for locking is not operated, and being prevented, when said means for locking is operated.

17. An armored vehicle according to claim 16, and wherein said circular track means comprises an inner track member rotationally associated with said annular portion, and coaxially mounted within an outer track member associated with said outer portion of said base means.

18. An armored vehicle according to claim 17, and wherein said circular track means also comprises:

a circular track member mounted onto the upper portion of the vehicle and defining inner and outer coaxial engagement portions associated with said inner track member and said outer track member respectively;

inner bearing means disposed between said inner engagement portion and said inner track member; and outer bearing means associated with said outer track member.

19. An armored vehicle according to claim 15, and wherein said base means comprises circular base means rotatably mounted onto said upper portion of said vehicle.

20. An armored vehicle according to claim 14, and wherein said means for mounting comprises a four-bar mounting system operative to permit rotation of said hatch cover between said first and second extreme positions along a predetermined rotation arc, such that at every point along said rotation arc said hatch cover has a predetermined angular orientation relative to said outer portion of said base means.

21. An armored vehicle according to claim 20, and wherein said four-bar mounting system comprises:

mounting means mounted onto said outer portion of said base means and defining first and second axes generally parallel to an upper surface of said vehicle;

a first, inner pair of elongate members defining respective first end portions mounted for rotation about said first axis, and also defining respective second end portions attached to said hatch cover for pivoting about a third axis associated therewith, said third axis being parallel to said first and second axes; and a second, outer pair of elongate members defining respective first end portions mounted for rotation about said second axis, and also defining respective second end portions attached to said hatch cover for pivoting about a fourth axis associated therewith and parallel to said third axis, said first, second, third and fourth axes defining the vertices of a parallelogram, thereby defining said predetermined rotation arc of said hatch cover between said first and second extreme positions.

22. An armored vehicle according to claim 21, and also including means for locking said hatch cover in any of a plurality of predetermined positions along said predetermined rotation arc.

23. An armored vehicle according to claim 22, and wherein said means for locking comprises a single locking member for lockably engaging said hatch cover with predetermined portions of a predetermined pair of members selected from the following group:

said first pair of elongate members; and said second pair of elongate members.

24. An armored vehicle according to claim 23, and wherein said means for locking comprises means for locking said hatch to a predetermined one of said first pair of elongate members.

25. An armored vehicle according to claim 14, and wherein said inner portion of said base means also comprises means for supporting machine gun apparatus.

26. An armored vehicle according to claim 25, and wherein said base means defines upper and lower sides and said means for supporting machine gun apparatus is mounted onto said upper side of said base means, and said hatch assembly also comprises means, associated with said base means, for operating said machine gun apparatus from said lower side of said base means.

* * * * *